US006775503B2

(12) United States Patent
Hattori et al.

(10) Patent No.: US 6,775,503 B2
(45) Date of Patent: Aug. 10, 2004

(54) IMAGE FORMING APPARATUS WITH IMPROVED CAPABILITIES FOR TONER SUPPLY

(75) Inventors: Yoshio Hattori, Kawasaki (JP); Takaaki Yanagisawa, Tokyo-to (JP); Kazuhisa Sudo, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 74 days.

(21) Appl. No.: 10/133,484

(22) Filed: Apr. 29, 2002

(65) Prior Publication Data

US 2003/0016966 A1 Jan. 23, 2003

(30) Foreign Application Priority Data

Apr. 27, 2001 (JP) ..... 2001-132478
May 28, 2001 (JP) ..... 2001-159034

(51) Int. Cl.[7] ..... G03G 15/08; G03G 21/00
(52) U.S. Cl. ..... 399/258; 399/43; 399/88
(58) Field of Search ..... 399/258, 254, 399/256, 260, 43, 88, 75; 222/DIG. 1, 167; 406/52, 53, 54, 55

(56) References Cited

U.S. PATENT DOCUMENTS

| | | | | |
|---|---|---|---|---|
| 5,953,567 A | * | 9/1999 | Muramatsu et al. | 399/256 |
| 6,122,468 A | | 9/2000 | Sakamoto et al. | 399/223 |
| 6,163,669 A | | 12/2000 | Aoki et al. | 399/159 |
| 6,198,895 B1 | | 3/2001 | Tsuda et al. | 399/267 |
| 6,201,941 B1 | * | 3/2001 | Kasahara et al. | 399/258 |
| 6,249,304 B1 | | 6/2001 | Sawayama et al. | 347/228 |
| 6,295,437 B1 | | 9/2001 | Hodoshima et al. | 399/346 |
| 6,337,957 B1 | | 1/2002 | Tamaki et al. | 399/29 |
| 6,393,241 B1 | | 5/2002 | Matsumoto et al. | 399/258 |
| 6,501,913 B2 | | 12/2002 | Hattori et al. | 399/12 |
| 6,505,022 B2 | | 1/2003 | Kosuge et al. | 399/159 |
| 6,507,720 B2 | | 1/2003 | Kabumoto et al. | 399/258 |
| 6,522,855 B1 | | 2/2003 | Katoh et al. | 399/274 |
| 6,526,246 B2 | | 2/2003 | Iwata et al. | 399/258 |
| 6,542,707 B2 | * | 4/2003 | Muramatsu et al. | 399/258 |
| 2001/0021326 A1 | * | 9/2001 | Yanagisawa et al. | 399/258 |
| 2002/0009310 A1 | * | 1/2002 | Kabumoto et al. | 399/258 |

FOREIGN PATENT DOCUMENTS

| | | |
|---|---|---|
| JP | 6-175488 | 6/1994 |
| JP | 11-073079 | 3/1999 |
| JP | 2000-047465 | 2/2000 |
| JP | 2000-098849 | 4/2000 |
| JP | 2001-034064 | 2/2001 |
| JP | 2001-051569 | 2/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A toner supply unit powder pump of an electrophotographic image forming apparatus is driven by an exclusive motor independently of a main motor driving major parts of the image forming apparatus. Thereby, the toner supply unit can implement responsive supply of toner unaffected by operation mode changes with a simpler construction. A toner supply system can use plural powder pumps for plural color developing stations. By considering distance and elevation of toner transport paths to respective stations, appropriate pump revolutions can be determined for respective stations, to achieve desirable toner transport amounts to respective stations in relatively short time with a simpler construction supply unit. A method precisely controls toner transport amounts by intermittently driving the powder pump with an arbitrary unit driving time. When the arbitrary unit driving time is changed to another unit driving time, the pump is driven transiently with the still another unit driving time.

15 Claims, 16 Drawing Sheets

AMOUNT OF TONER TRANSPORT PER UNIT TIME VS TRANSPORT TIME

IMAGE FORMING APPARATUS WITH IMPROVED CAPABILITIES FOR TONER SUPPLY

BACKGROUND

1. Field of the Invention

This patent specification relates generally to an image forming method and apparatus, and more specifically to such apparatus for use in digital copying, printing machine and facsimile apparatus, provided with improved toner transport capabilities.

2. Discussion of the Background

The electrophotographic image forming process is well known. In image forming apparatuses such as a copying machine, printer and facsimile apparatus, in general, the formation of the images is carried out through the electrophotographic process steps of forming electrostatic latent images on an image bearing member or photoreceptor, developing as visible toner images using toner particles, and transferring the toner images onto a copy sheet which subsequently passes through a fixing unit to form fixed images on the sheet.

When the amount of toner in the fixing unit decreases during the developing steps, the toner is supplied to the fixing unit from a toner container in a copying apparatus, which may be housed separately from one another.

In regard to the toner, some portion thereof remains on the photoreceptor as residual toner following the transfer of toner images during the developing steps. As is well known, this residual portion of the toner is then removed from the photoreceptor by scraping off with a cleaning blade housed in a cleaning unit.

With increasing concern for resources and operation costs in recent years, recycling of the used toner material has been attracting considerable attention. For example, Japanese Laid-Open Patent Application No. 6-175488 discloses that the used toner is collected and returned by a toner transport unit to a developing unit to be admixed with fresh toner material, and is subsequently reused for forming toner images on the image bearing member.

As to the above noted toner transport unit, a powder screw pump (or powder pump) is generally included for its design flexibility and capability of transporting powder materials. In addition, the process of the toner transport is also known, which is pneumatically carried out for an admixed system of the recovered toner and gaseous flow generated by an air pump (Japanese Laid-Open Patent Application No. 11-73079).

The powder pump is formed, as previously known, to be a suction type uniaxial-eccentric screw pump (i.e., uniaxial pump having eccentric screw structure), including at least a stator which is provided with a through hole, and a rotor. The rotor has a screw-shaped surface structure, and is rotatably interfit to the stator along the axis of the cylindrical holder in contact with inner face of a wall of the stator. This uniaxial-eccentric powder pump is also known to be capable of transporting a relatively constant amount of material continuously at high mixing ratio with air, to thereby be able to attain precise amount of the toner transport.

An image forming apparatus has been previously disclosed in Japanese Laid-Open Patent Application No. 2000-47465 by the present inventors, in which the toner is transported by such uniaxial-eccentric powder pump incorporated into the apparatus.

In that disclosure, the powder pump in the image forming apparatus was designed, as shown in FIG. 7, to be driven directly by a motor 100 which also serves to drive major parts of the apparatus such as sheet supply unit, and developer and fixing stations. In addition, the developer station herein utilized a two-component developer containing toner and carrier components, and the station was controlled to maintain the toner concentration approximately constant by means of a toner supply unit. With this construction, the toner supply unit was able to support any mode of printing operation including solid monochrome printing.

The amount of toner transported in unit time by the powder pump was measured as a function of the number of rotor revolution of 125 rpm, 250 rpm and 400 rpm, with a pump having similar characteristics for identical distance and elevation to transport path. The results obtained from the measurements are shown in FIG. 8.

The results indicate, although the amount of toner transported in unit time reach approximately the same level of 50 mg/sec with the transport time of 500 msec or larger for each of rotor revolution of 125 rpm, 250 rpm and 400 rpm, the transient change during leading periods is considerably different (FIG. 8).

It should be noted herein that the number of revolutions for the main driving motor 100 may arbitrarily be adjusted, for example, to be smaller for relatively thick transfer sheets, or to be larger in a faster printing mode. When the number of revolutions decreases for the main motor, therefore, the number for the rotor also decreases accordingly.

As a result, for the previous construction of the toner transport system, difficulties may be encountered such that responsive toner supply can not be carried out for the slower mode of printing, to thereby not be able to produce a maximum sized printing in solid color.

Also, the distance and elevation of the transport path may be different. For example, for a full color image forming apparatus equipped with a toner supply unit incorporating plural powder pumps, the distances for the toner transport L1, L2, L3 and L4, and the elevations (differences in height) H1, H2, H3 and H4, for the stations 4M, 4C, 4Y and 4Bk, respectively, differ from each other as illustrated in FIG. 9.

As a result, the toner transport capability also differs for respective toner transport paths, thereby causing further complications for the toner transport including its control system, among others.

SUMMARY OF THE INVENTION

It is therefore an object of the present disclosure to provide a toner supply unit and image forming apparatus incorporating such supply unit, which are capable of implementing responsive supply of the toner unaffected by the operation mode change with preferably simpler construction of the supply unit.

In another aspect, with the decrease in the overall size of a development unit in recent years, there exists increasing needs of more precise control of the powder pump, which will be detailed herein below.

Utilizing the powder pump, the toner transporting unit is devised to be capable of securely transporting the toner, which is recovered from the cleaning unit, admixed with gaseous flow through a transport tube made of elastic materials.

From the consideration of durability, sealing performance, temperature increase, and powder scattering, the secure transportation can be achieved by operating the pump not continuously but intermittently over specified periods of time, when the amount of toner in a toner reservoir is measured, by a toner level detecting means, and then found to have reached a predetermined value.

In addition, also disclosed is the toner transporting unit incorporating the powder pump, which is alternatively configured to be capable of initiating the intermittent pump operation when an accumulated count of copied sheets reaches a predetermined number, in place of the above-mentioned method for determining the timing for initiating the pump operation based on the detected amount of toner in the toner reservoir.

The toner transporting unit utilizing the powder pump is thus operated, as noted above, not continuously but intermittently. This operation mode consists of, for example, driving with a unit driving time of 0.1 sec, 0.2 sec, etc. and halting with a unit halting time of 3 sec, 4 sec, etc. That is, the intermittent operation may be iterative cycles repeated a certain times, each cycle consisting of 0.1 sec of driving followed by 3 sec of halting, for example, thereby attaining a desired amount of the toner supplied to the developing unit.

With the decrease in the overall size of a developing unit in recent years, the amount of developer stored therein has also decreased.

Since the concentration of the toner in the developer tends to considerably fluctuate with more ease in the developing unit in such reduced size, the amount of toner supplied by the powder pump has to be controlled more precisely to maintain proper supply amount and concentration of the toner.

However, there has not been achieved so far methods for implementing precise control of the proper toner amount including proper consideration of the characteristics of powder pump.

These characteristics of powder pump are illustrated in FIG. 15, for example, which includes graphical plots illustrating the change of the toner amount (g) with time for unit driving times switched among the values of 0.1 sec, 0.2 sec and 0.3 sec, and with the number of rotor (rpm) kept constant.

Referring again to FIG. 15, after carrying out a first set of intermittent drives with unit driving time of 0.1 sec repeated 15 times, the unit driving time is switched to 0.2 sec, in which the desirable toner supply amount of 0.04 g for the unit driving time of 0.1 sec is approximately attained and remains stable at that level.

When the unit driving time is subsequently switched to 0.2 sec, the desirable toner supply amount of 0.08 g for the unit driving time of 0.2 sec can not be reached immediately after initiating a second set of intermittent drives with unit driving time of 0.2 sec. Furthermore, this desirable amount of 0.08 g is achieved only after a delay period which corresponds to 10 times of intermittent drives with the 0.2 sec unit time.

A similar delay period is also observed for the intermittent drive with the unit driving time switched from 0.2 sec to 0.3 sec. In a similar manner, when the unit driving time is switched from a one unit driving time (e.g., 0.2 sec) to a shorter one (0.1 sec), the toner supply amount can not decrease immediately, but the target amount of toner supply can be achieved only after another certain delay period.

As described herein above, when the unit driving time is switched from one to another in the previous methods utilizing the powder pump, the desirable supply amount of toner can be achieved only after delayed supply period corresponding the transient change (either increase or decrease) in the supply amount of the toner.

That is, immediately after switching the unit driving time, the change in toner supply amount can neither follow the switching speedily, nor attain the desired supply amount corresponding to newly adjusted unit driving time, but this desirable amount can be achieved only after a delay period, whereby another stable level of the amount of toner supply can be attained.

It is found through the above noted experimentation by the inventors that, when a set of intermittent drives are carried out following the previous set of intermittent drives with different unit driving time, a speedy change in supply amount can not be achieved possibly due to the toner left out in the powder pump during the previous intermittent drives, for example.

The present inventors further investigated the reasons for such a delay. The powder pump herein is devised of a stator which is fixed in the interior of a cylindrical holder, having a screw-shaped hollow structure inside thereof, and a rotor with another screw-shaped surface structure which is provided rotatively along the axis of the cylindrical holder in contact with inner face of the walls of the stator.

Since the rotor is provided with this structure to be enshrouded by the stator while retaining a passage formed along the cylindrical axis, the toner can be transport by the air pressure generated inside the passage by the rotation of the rotor.

In addition, the transport capability of the powder pump is therefore proportional to the cross-sectional area of the passage between the stator and rotor, and the amount of toner to be transported in unit time is that amount transported through the passage area in unit time.

If the size of the toner particles is quite small, it is found that the passage of the particles after switching the mode and conditions for the transport is affected by the properties (such as specific gravity and density) of toner which is left out during a previous transport mode.

Also found is that the effect of the previous transport mode on the following mode persists until the entire toner related to the previous drive is disposed completely from the inner space between the stator and rotor, and then a stable amount of toner supply can be achieved after this complete disposition.

It is therefore another object of the present disclosure to provide a method for implementing precise control of the toner transport by means of a powder pump incorporated in an image forming apparatus through suitable intermittent drives including proper consideration of the characteristics of powder pump.

To be more specific, the object is to provide the methods capable of alleviating undue delay in responding to the desirable change in the amount of transporting the toner by means of the powder pump, even when the unit driving time is changed.

In addition, it is another object to find a relationship, which can specify the number of repetitive transient drives carried out between one set of intermittent drives with a first unit driving time and another set of intermittent drives with a second unit driving time, and which is able to alleviate undue effects of the first unit time drives on the second unit time drives.

Accordingly, there are provided in the present disclosure a method and apparatus for implementing precise control of the proper amount of transporting toner by a powder pump incorporated in a copying apparatus, having most, if not all, of the advantages and features of similar employed methods, while eliminating many of their disadvantages.

The following brief description is a synopsis of only selected features and attributes of the present disclosure. A more complete description thereof is found below in the section entitled "Description of the Preferred Embodiments"

A toner supply unit is disclosed herein incorporated into an image forming apparatus for supplying toner from a toner container to a developing unit by a powder pump.

The powder pump includes at least a stator provided therein with a through hole and a rotor rotatably interfit to the through hole in the stator, and is characterized by being driven by its exclusive motor independently of a main motor provided for driving major parts of the image forming apparatus. This toner supply unit is further characterized by the number of revolution of the powder pump of equal to, or greater than 250 rpm.

According to another aspect, a toner supply system with plural powder pumps is disclosed incorporated into an image forming apparatus for supplying toner. The image forming apparatus includes at least a plurality of developing stations, and the toner is supplied to these developing stations from respective toner containers by respective powder pumps included in the toner supply system.

Each of the powder pumps includes at least a stator provided therein with a through hole and a rotor rotatably interfit to the through hole in the stator, and is characterized by being driven by an own exclusive motor independently of a main motor provided for driving major parts of the image forming apparatus.

This toner supply system is further characterized by the number of revolutions of each of the powder pumps adjusted either individually in advance or corresponding to the distance and elevation of toner transport path to each of the plurality of developing stations.

According to still another aspect, an image forming apparatus disclosed herein includes at least a developing unit for forming a toner image by developing a latent image formed on an image bearing member using toner supplied to the image bearing member, a powder pump for transporting the toner to the developing unit, and a control unit for driving the powder pump.

The powder pump herein includes at least a stator provided therein with a through hole, a rotor rotatably interfit to the through hole in the stator, and a motor for rotating the rotor, and is configured to transport toner by drawing from one end of the through hole, disposing through the other end of the through hole, and conveying the toner to the developing unit.

The powder pump is characterized by being driven intermittently with an arbitrary unit driving time, and, when the arbitrary unit driving time is changed to another unit driving time, driven transiently with still another unit driving time different from either the arbitrary unit driving time or the another unit driving time.

This image forming apparatus is further characterized, when the arbitrary unit driving time is changed to another unit driving time, by the least number, X, of driving the powder pump with the arbitrary unit driving time for causing undue delay of toner transport, is determined by the relation $$X \geqq 60P/nT,$$

where p is a number of rotor pitch, n is the number of rotor revolution (rpm), and T is the arbitrary unit driving time.

The image forming apparatus is also characterized by the largest number, Y, for limiting the transient driving of the powder pump with still another unit driving time, which is carried out following the intermittent driving of the powder pump performed for X times with the arbitrary unit driving time, is determined by the relation $$Y \geqq 60P/nT,$$

where p is a number of rotor pitch, n is a number of rotor revolution (rpm), and T is the still another unit driving time.

According to another aspect, a method is disclosed for controlling an amount of toner transported by a toner supply system incorporated into an image forming apparatus for supplying toner.

The image forming apparatus includes at least a plurality of developing stations, and the toner is supplied to the plurality of developing stations from respective toner containers by respective powder pumps included in the toner supply system.

Each of the powder pumps includes at least a stator provided therein with a through hole, and a rotor rotatably interfit to the through hole in the stator.

The present method for controlling an amount of toner transported includes at least the step of driving each of the powder pumps by its own exclusive motor independently of a main motor provided for driving major parts of the image forming apparatus.

This method is characterized by the number of revolutions of each of the respective powder pumps adjusted either individually in advance or corresponding to the distance and elevation of toner transport path to each of the plurality of developing stations.

Further methods for controlling an amount of toner transported by a powder pump are also described in this disclosure.

The present disclosure and features and advantages thereof will be more readily apparent from the following detailed description and appended claims when taken with drawings.

DESCRIPTION OF THE PREFERRED EMBODIMENTS

In the detailed description which follows, specific embodiments on a toner transport unit included in an image forming apparatus are described. It is understood, however, that the present disclosure is not limited to these embodiments, and it is appreciated that the apparatus and method for transporting toner disclosed herein may also be adaptable to any form of materials transport. Other embodiments will be apparent to those skilled in the art upon reading the following description.

Figure 1:
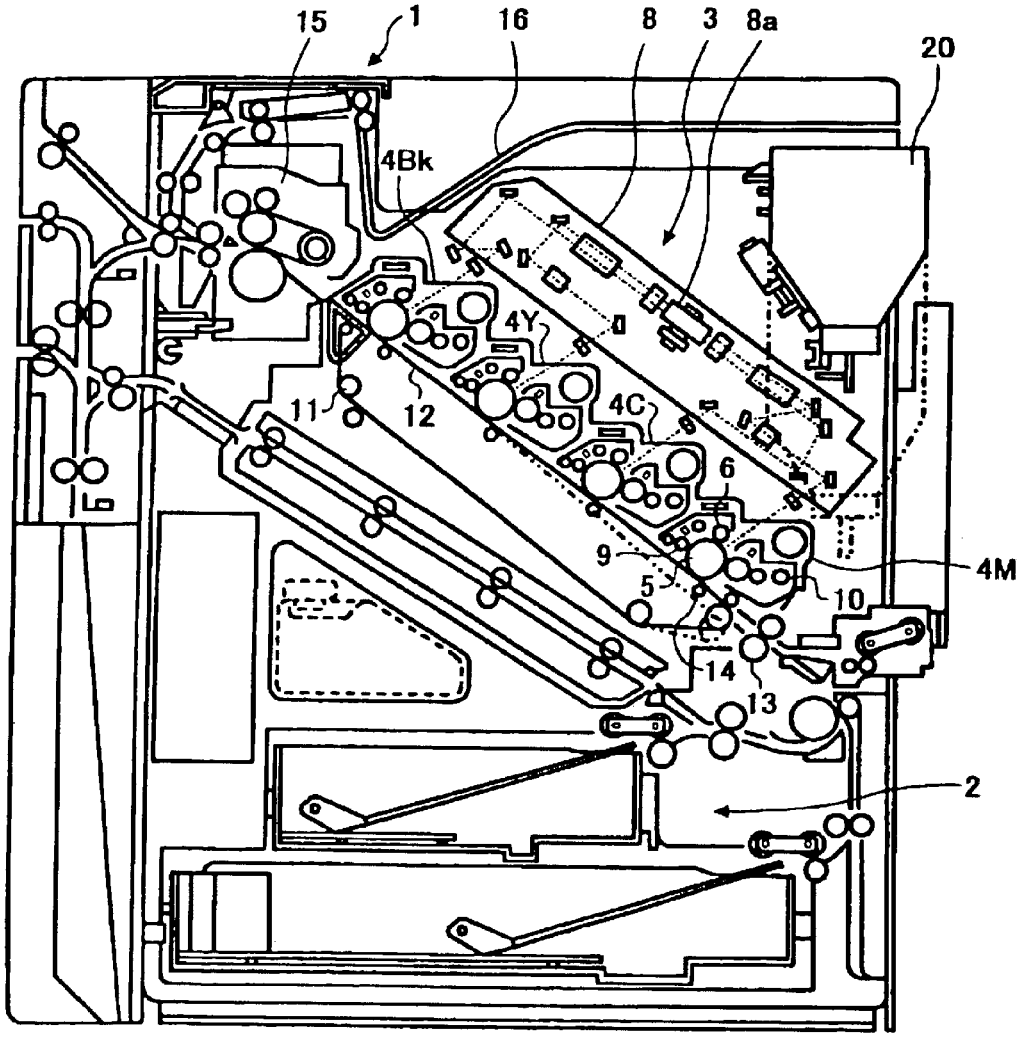
FIG. 1 is a schematic side view of a color image forming apparatus provided with a toner supplying unit according to one embodiment disclosed herein.

FIG. 1 is a schematic side view of a color laser printer as an example of the image forming apparatus provided with toner transporting unit according to one embodiment disclosed herein.

Referring to FIG. 1, the color laser printer includes at least a sheet supply unit 2 provided in the lower portion of the printer console 1, and image forming unit 3 housed above the sheet supply unit 2.

The image forming unit 3 includes a transfer belt unit which is slantingly installed with its paper receiving end in the bottom to receive papers fed from a feeder, and its paper disposing end on the top to dispose the papers following the image formation.

In addition, the transfer belt unit includes an endless transfer belt 12 which is provided to be wound wrapping plural supporting rolls 11, and four development stations 4M, 4C, 4Y and 4Bk in series from the bottom, for use in magenta (M), cyan (C), yellow (Y) and black (Bk), respectively.

Each of the stations, 4M, 4C, 4Y and 4Bk, is provided with a photoreceptor drum 5, which is rotatory driven clockwise by a driving means (not shown). In addition, provided on the periphery of the photoreceptor drum 5 are a charging roll 6 as a charging means, an image inputting means 8 to input image data by laser beams, a developing unit 10 as the developing means, and a cleaning unit 9 as the cleaning means.

The developing unit 10 herein is formed as a two-component developing system, which utilizes toner and carrier components as the developer. In addition, the developing unit 10 is operated to maintain an approximately constant level of toner concentration by appropriately supplying to replenish the toner consumed, which will be detailed later on.

Referring again to FIG. 1, the steps for carrying out full color printing process are now described in regard to the magenta station 4M, as an example.

The surface of the photoreceptor drum 5 is uniformly charged by a charging roll 6. Onto the photoreceptor drum 5, the input steps of light image to be formed with the magenta toner are carried out by a light image forming unit 8.

The light image forming unit 8 herein is configured to first emit a laser beam from a laser diode (LD) (not shown), then refract the beam, lead the beam to the rotating polygonal mirror 8*a*, and subsequently direct a reflected light beam onto the photoreceptor drum 5 by way of cylindrical lens and several optical devices, whereby the light image to be formed with the magenta toner is formed on the photoreceptor drum 5.

With these steps of the light image input, electrostatic latent images are formed on surface of the photoreceptor drum 5 corresponding to the image data transmitted from a host machine such as, for example, a personal computer. The thus formed latent images are subsequently rendered visible with magenta toner by the developing unit 10.

On the other hand, being designated presently as transfer sheets, sheets of paper are fed from the sheet supply unit 2, and these sheets are then forwarded to a registration pinch roll pair 13 which is located on upstream side of the sheet feeding direction. Subsequently, the sheets are fed forward onto the transfer belt 12 in coincidence with the timing for forming the above noted visible image, then forwarded to the proper transfer position opposing to the photoreceptive drum 5.

At the transfer position, visible images of magenta toner are formed on the transfer sheet by a transfer roll 14 which is located in the rear of transfer belt 12 from the photoreceptor drum 5.

In similar manner, visible images of cyan, yellow and black toners are formed, respectively. Namely, each of the stations for forming cyan, yellow or black toner images carries out the visible image formation with respective toner by a transfer roll 14 which is located in the rear of transfer belt 12 from the photoreceptor drum 5, and at the instance when the traveling sheet reach at each exact location for the respective color image to be transferred, the respective color images are transferred to be overwritten, whereby a full color image can be formed.

Following the image transfer, the transfer sheet is separated from the transfer belt 12, and the transferred images are permanently fixed at the fixing unit 15.

After fixing the toner image, the copy sheet is either forwarded to the exterior of the printing machine, or advanced downwardly to a collecting tray 16, which is provided on the top portion of the printer console. This way of downward collection of the sheets facilitates to fulfill one of requisites for sheet handling, i.e., stacking sequentially in order of page number.

Figure 2:
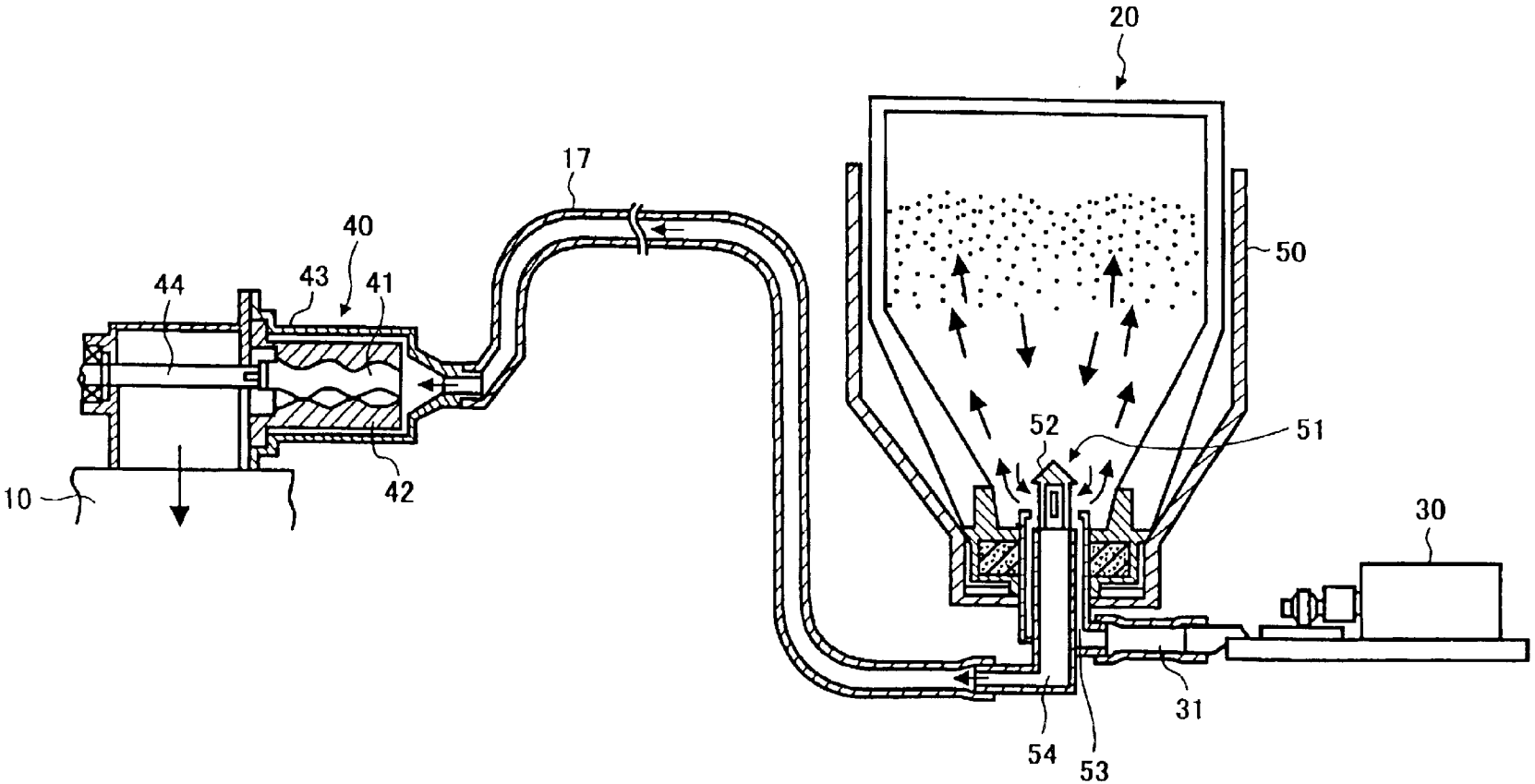
FIG. 2 is a schematic side view illustrating the toner supply unit including a powder pump and a toner container according to one embodiment disclosed herein.

FIG. 2 is a schematic view illustrating the toner supplying unit including a toner container according to one embodiment disclosed herein.

Referring to FIG. 2, the developing unit 10 is devised such that toner is drawn by suction force from a powder pump 40 operative as a toner drawing means, and supplied to the unit 10 by way of a transport tube 17. A suction type uniaxial-eccentric powder pump is herein used as the powder pump 40, and placed above the developing unit 10.

The powder pump 40 consists of a rotor 41 which is made of rigid material such as metal, for example, having a surface structure of eccentric screw, and a stator 42 which is made of plastic material such as rubber, having an inner surface structure of twin screws and is provided being fixed in the interior of a cylindrical holder 43 made of plastics.

With this structure, therefore, the rotor 41 is arranged to be enshrouded by the stator 42, while retaining a passage formed along the cylindrical axis throughout pump rotation.

On the other hand, a setting unit 50 is also included in the image forming apparatus 1 as a unit separable from the console of the apparatus 1, where relevant. This setting unit 50 is formed for a toner container 20 to be housed in upright manner with its bottom circular edge being fit to the opening of nozzle 51.

The nozzle 51 is formed to have a conical tip portion 52. In addition, the nozzle 51 has a double tube structure there within, and the partition thereof serves to separate an air intake path 53 from a toner discharge path 54. The toner discharge path 54 is extended downward, and then bent (toward the left in FIG. 2) to be interfit to the above noted toner transport tube 17.

On the other hand, the air intake path 53 is extended also downward to less extent, and then bent (toward the right in FIG. 2) to be connected to an air pump 30 by way of an air transport pipe 31.

On operating the air pump 30, the air taken thereinto is forwarded to the toner container 20 by way of air transport pipe 31 and air intake path 53, and then blows out from bottom into the container 20. On passing the accumulation of toner, the thus blown air serves to stir and then fluidize the toner inside the toner container 20.

Since the aforementioned powder pump 40 is so devised as to be capable of transporting an approximately constant amount of material continuously at a high mixing ratio with air, a precise amount of the toner transport can be achieved in proportion to the number of revolutions of the rotor 40.

Figure 3:
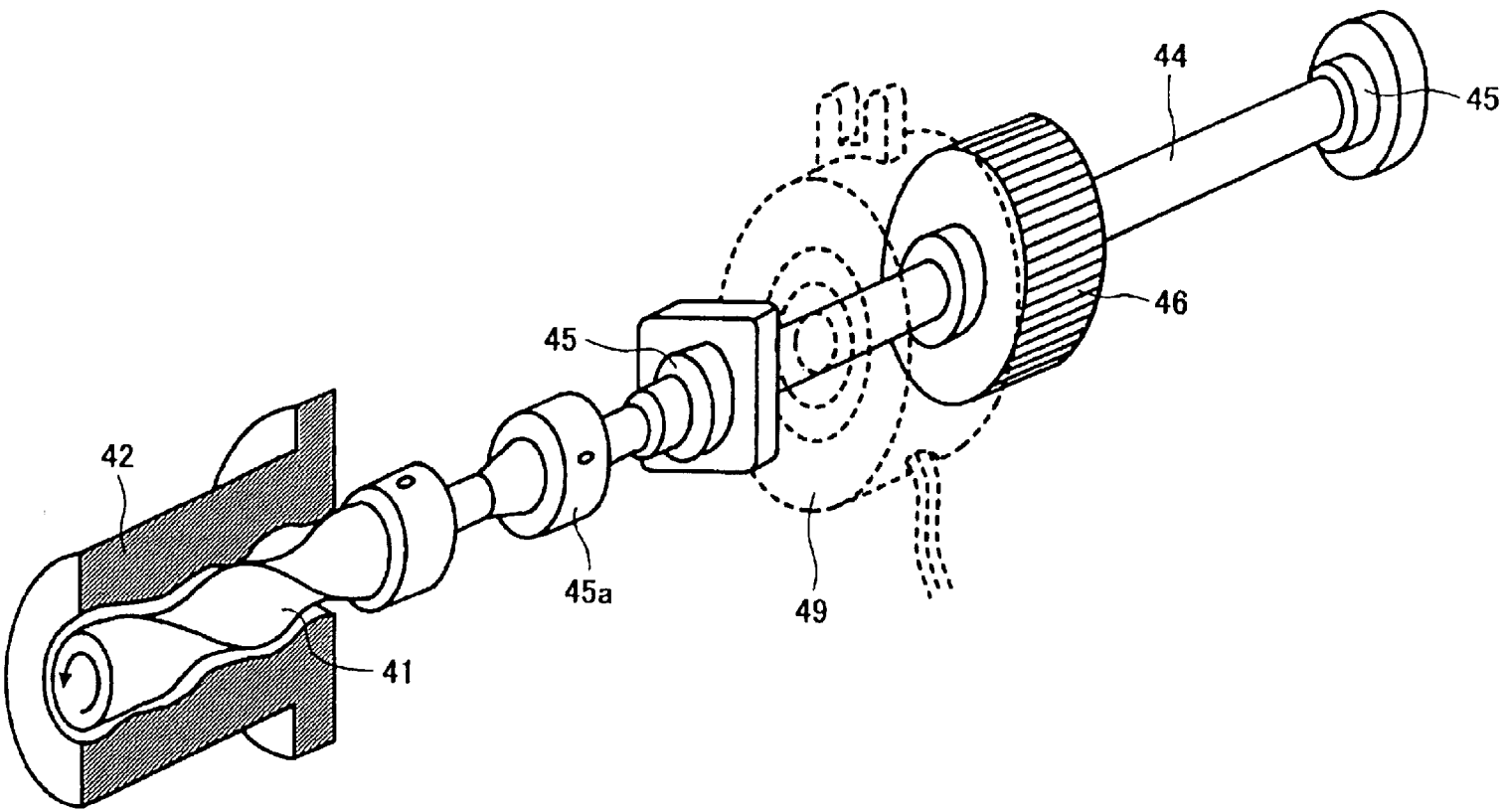
FIG. 3 is a schematic diagram illustrating driving mechanism for the powder pump according to one embodiment disclosed herein.

Referring to FIG. 3, the powder pump 40 includes at least the rotor 41 which is connected to the tip of a driving axis 44 that is rotatably supported by a bearing 45 by way of a connecting axis 45*a*. In addition, a gear 46 is attached to the driving axis 44.

Figure 4:
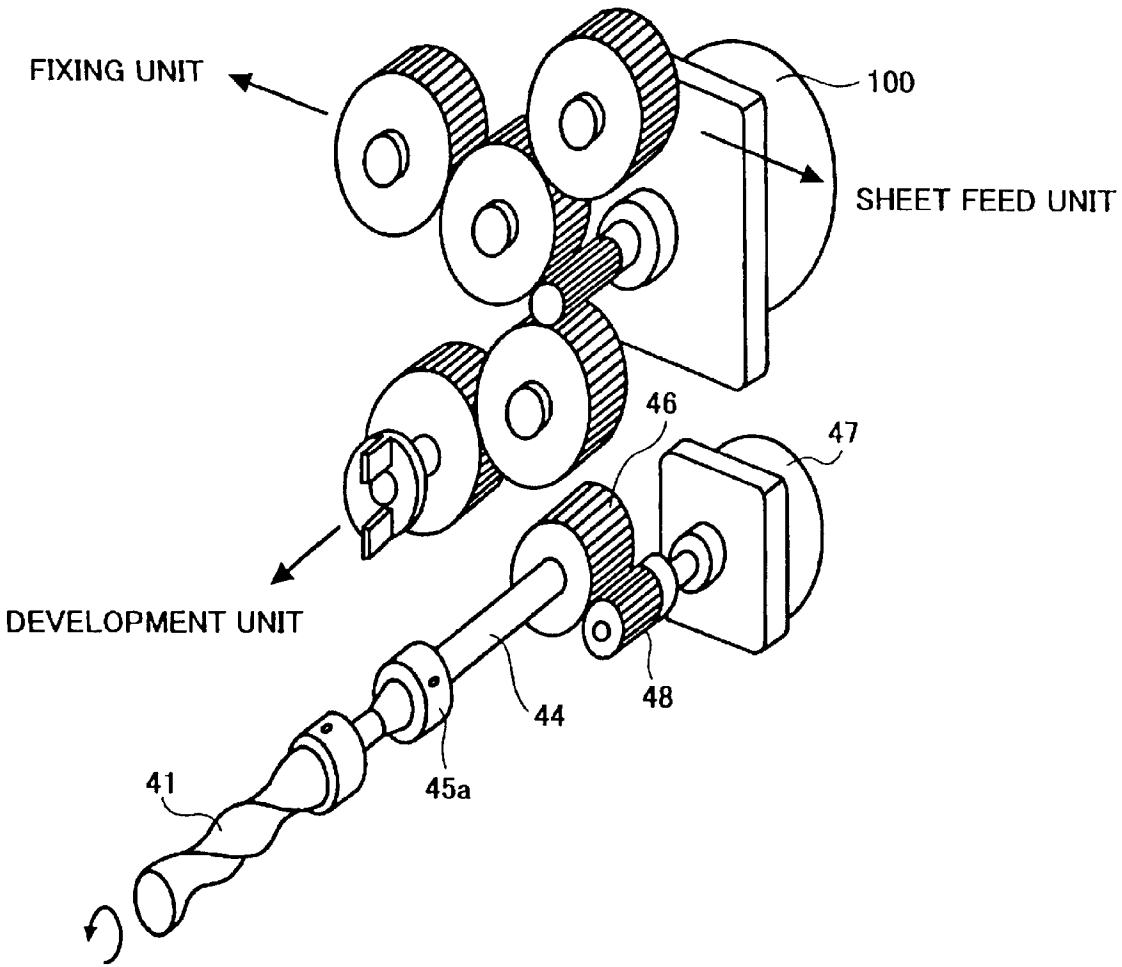
FIG. 4 is a schematic diagram illustrating driving mechanism for the powder pump according to another embodiment disclosed herein.

Furthermore, as shown in FIG. 4, the gear 46 is engaged with a driving gear 48 which is driven by a supplying motor 47. Therefore, the powder pump 40 can be operated independently of a main motor 100, which drives other major parts of the apparatus such as sheet supplying, developing and fixing units.

With the present construction, the rotation of rotor 41 can be maintained at a desired rotation unaffected by any change in the number of main motor revolutions. As a result, the toner supply by the powder pump 40 is sufficiently capable of supporting any mode of printing operation including solid monochrome printing such as, for example, solid black print.

It may be added herein that a clutch structure 49 may be annexed to the gear 46, as shown with dashed lines in FIG. 3, to suitably adapt to the difference in the response speed of the supplying motor 47. With this change in the structure of gear 46 with the clutch 49, undue concern can be obviated relating to the response delay during either rise or fall period of revolution.

For the abovementioned construction as illustrated in FIG. 4, in which the rotor 41 is driven not by the main motor but directly by its own exclusive motor, the number of revolutions of the powder pump 40 is preferably adjusted as follows.

Figure 8:
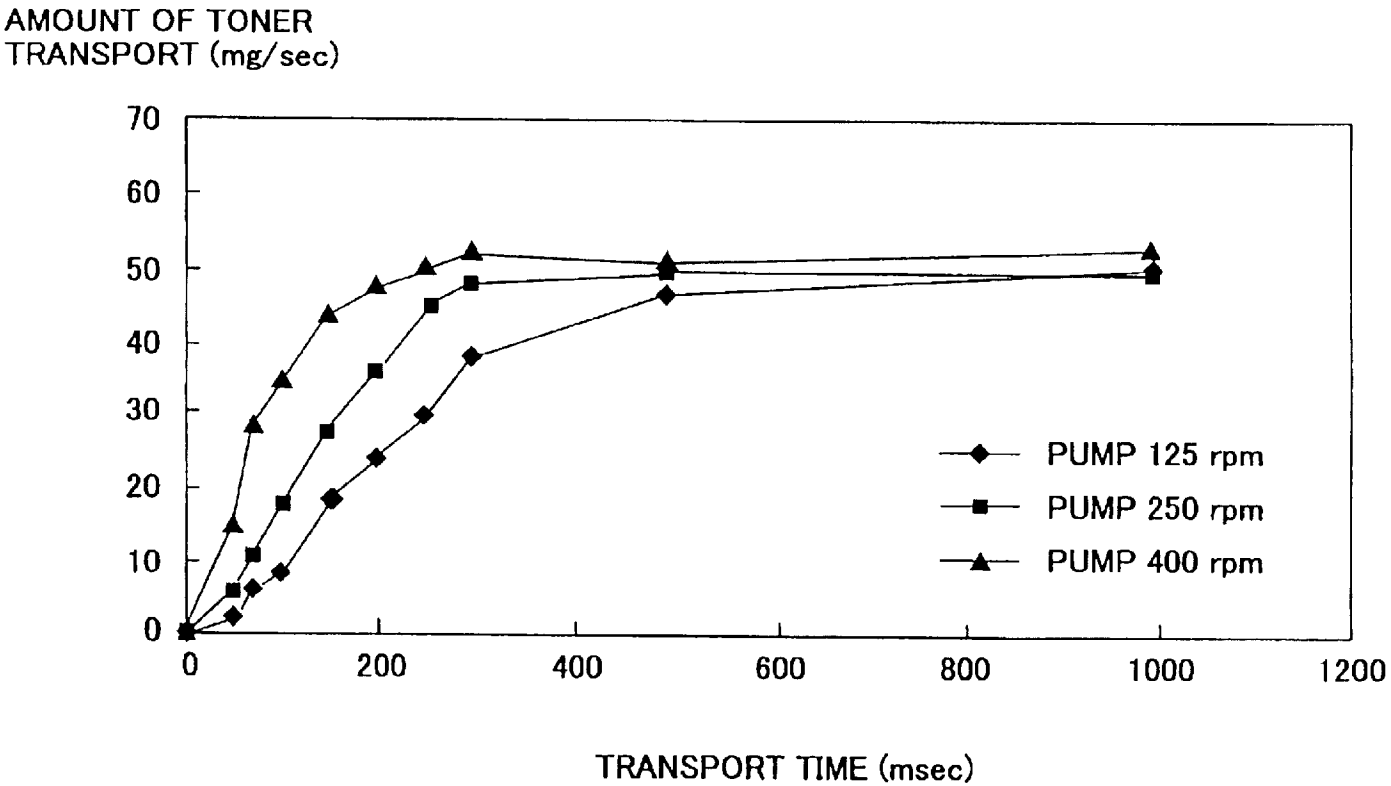
FIG. 8 contains graphical plots illustrating experimental results on the change of the amount of supplied toner as a function of supply time for various numbers of revolutions of the powder pump.
Figure 9:
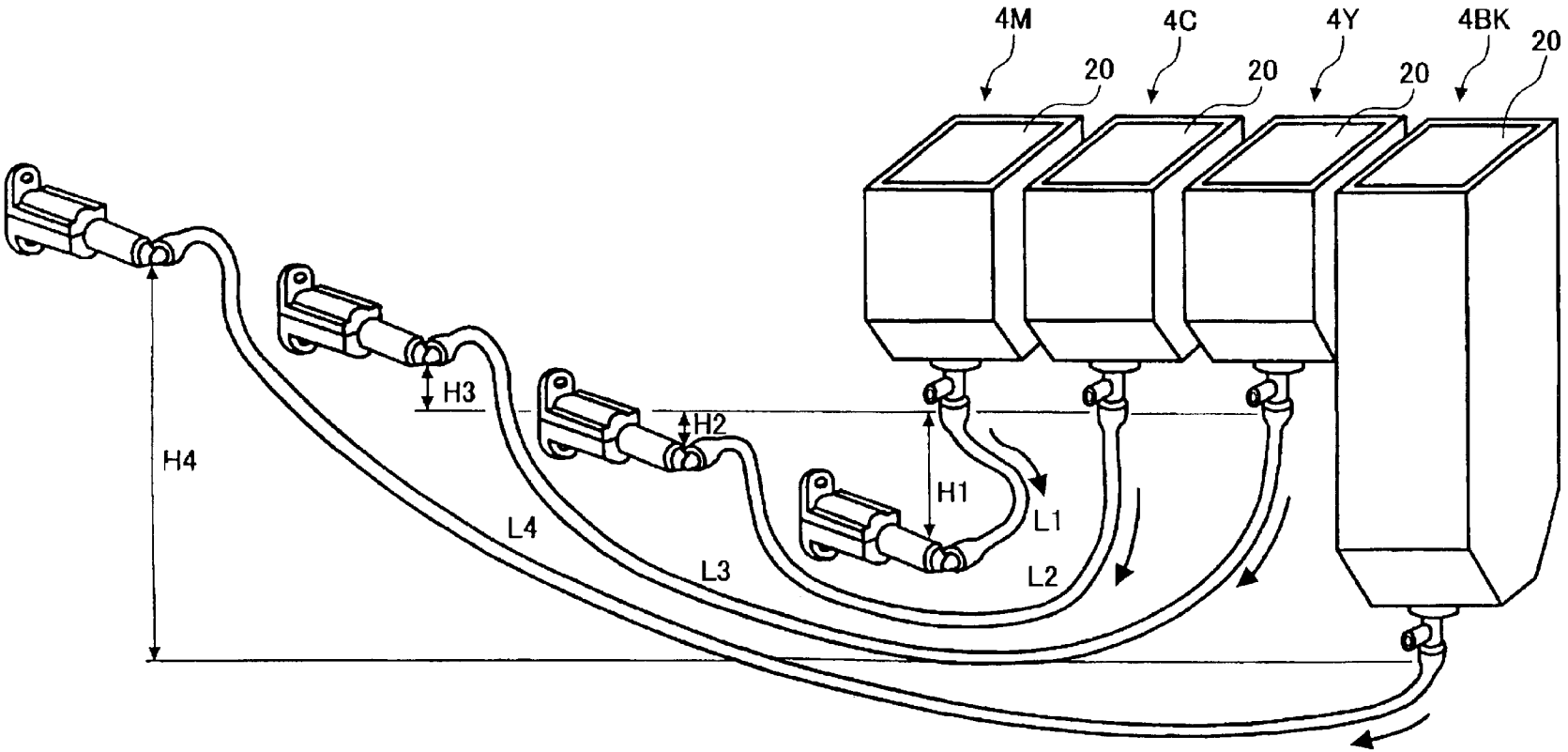
FIG. 9 is a schematic view illustrating the toner supply unit incorporating plural powder pumps, having the distances for the toner transport L1, L2, L3 and L4, and the elevations H1, H2, H3 and H4, for the stations 4M, 4C, 4Y and 4Bk, respectively.

Namely, after taking various factors into consideration such as the aforementioned experimental results illustrated in FIG. 8, and the delay of response caused by clutch movement, starting motor, or looseness at joint portions, minimum supplying time is considered to be at least 200 msec. In addition, since the number of the revolutions for achieving the stable supply is practically at least 250 rpm for the above minimum supplying time of at least 200 msec, it is preferable for the number of revolutions of the powder pump to be adjusted equal to, or greater than, 250 rpm.

The image forming apparatus disclosed herein is provided with four stations, 4M, 4C, 4Y and 4Bk, as indicated earlier. Although the supply pump 47 may be provided exclusively one for each of these four stations, the powder pump 40 of respective stations may alternatively be driven by a single motor, in which the aforementioned gear incorporating the clutch structure may suitably be utilized.

Since the respective powder pumps 40 may be driven independently of the rotation of the main motor even after adopting such gear structure as mentioned just above, the rotation of rotor 41 may be unaffected by possible change in driving mode of the image forming apparatus.

Figure 5:
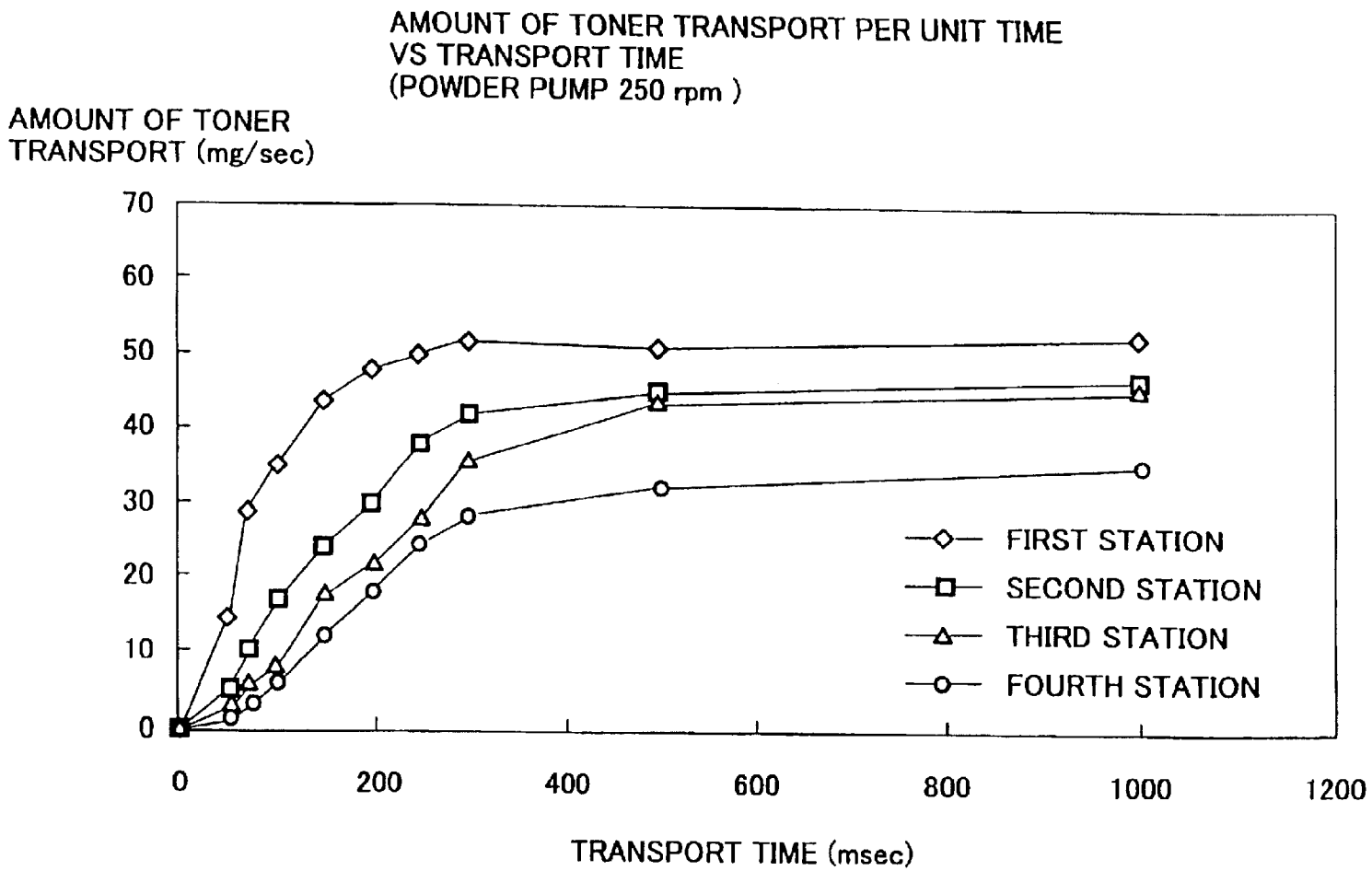
FIG. 5 contains graphical plots illustrating experimental results on the change of the amount of toner transported in unit time as a function of supply time for the stations 4M, 4C, 4Y and 4Bk.

Furthermore, it should be noted that the distance and elevation of the path for the toner be transported may be different from one station to another. When the powder pumps 40 of four stations are operated in an identical condition (e.g., 250 rpm), therefore, the amount of toner transported in unit time may differ from one station to another among the respective stations 4M, 4C, 4Y and 4Bk, as described earlier with the reference to FIG. 5.

Therefore, the toner transfer unit is constructed in the present embodiment such that no difference in the toner amount transported in unit time arises caused among the stations 4M, 4C, 4Y and 4Bk by adjusting the number of revolution of respective rotors 41 after considering the above noted distance and elevation.

This adjustment of the number of revolutions of respective rotors 41 may preferably be carried out by a gear combination (not shown) by suitably adjusting the gear ratio.

Figure 6:
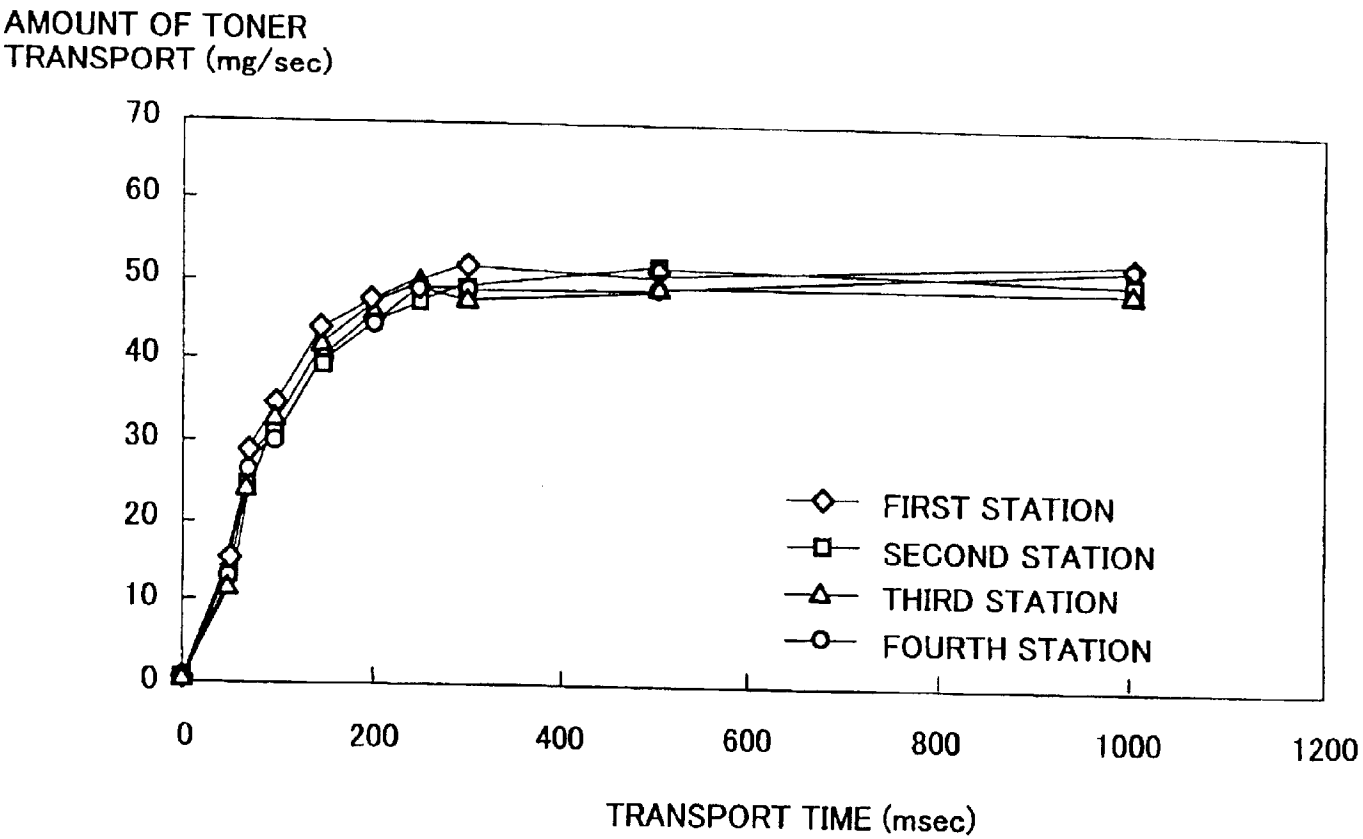
FIG. 6 contains graphical plots illustrating experimental results on the change of the toner amount of supplied to respective stations as a function of supply time after adjusting the number of revolutions of the rotors for respective stations.
Figure 7:
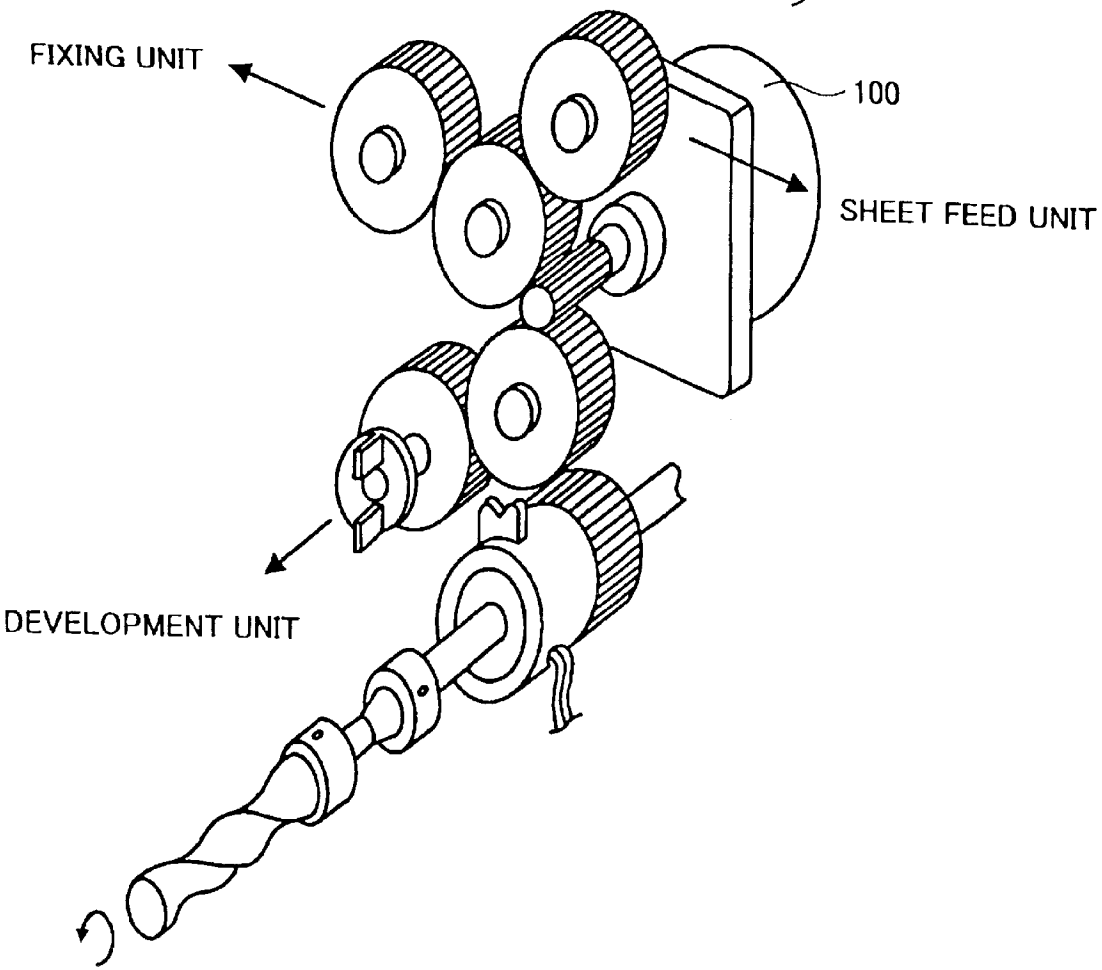
FIG. 7 (BACKGROUND ART)
FIG. 7 is a schematic diagram illustrating a prior driving mechanism for a powder pump.

The toner amounts transported in unit time to respective stations 4M, 4C, 4Y and 4Bk are thus brought to be approximately equal, as shown in FIG. 6, by adjusting the number of revolutions to be 250 rpm for the station 4M, 280 rpm for 4C, 300 rpm for 4Y, and 350 rpm for 4Bk, respectively.

As a result, the control of toner amount transported to the plural stations can be achieved by a single transport system, thereby facilitating to simplify the method and system for the control. It may be added herein that the numbers of revolutions in the above example may vary in practice depending on actual distance and elevation of transfer tubes 17 connected to the respective stations.

In another aspect, there exists in recent years increasing needs of more precise control of the toner supply unit incorporating a powder pump with the decrease in the overall size of developing unit, as noted earlier, which will be detailed herein below.

Figure 10:
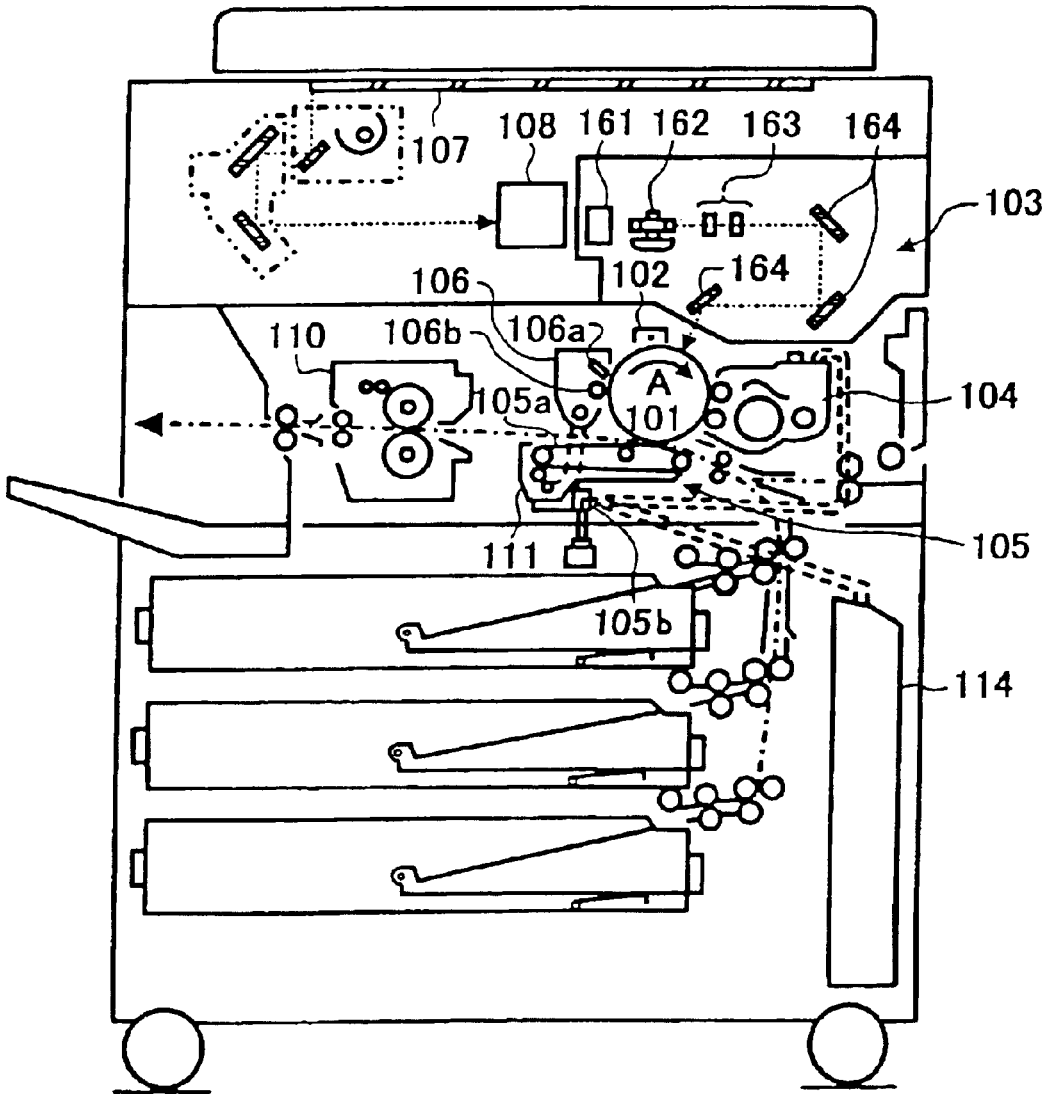
FIG. 10 is a schematic side view of an image forming apparatus according to another embodiment disclosed herein.

FIG. 10 is a schematic side view of a digital copying machine as another example of the image forming apparatus according to another embodiment disclosed herein. This copying machine is also provided with the capabilities for implementing image reproduction and printing utilizing known electrophotographic method.

Referring to FIG. 10, the copying machine includes at least a photoreceptor drum 101 as an image bearing member. Provided on the periphery of the photoreceptor drum 101 in a direction shown by the arrow A are a charging device 102, exposure unit 103 as the exposure means, developing unit 104 as the developing means, transfer unit 105 as the transfer means, and cleaning unit 106, which are configured altogether to implement the electrophotographic process steps.

The charging device 102 includes at least a casing housed therein a corona wire and grids provided at the opening portion of the casing opposing to the photoreceptor drum 101. With this structure of the charger, the negatively charged corona discharge generated by the corona wire is suitably controlled by the grids so as to achieve uniform charging in the dark of the surface of the photoreceptor 101 to a predetermined level of potential.

Following inputting image signals of a document to be copied, which is placed on a transparent contact glass 107 of the copying apparatus, the exposure means 103 is operated to suitably form an electrostatic latent image of the document on the surface of the photoreceptor drum 101 by exposing with laser beams modulated by the image signals previously input to the image inputting means 108.

The exposure means 103 herein includes at least a laser diode unit 161 (semiconductor laser as the light source), rotating polygonal mirror 162 for deflecting laser beams emitted from the laser unit 161, f-θ lens 163 for focusing scanning images, and mirror 164.

The thus formed electrostatic latent image on the surface of the photoreceptor 101 is then rendered visible as toner images by the developing unit 104 through the application of developing material. Subsequently, the toner images are electrostatically transferred to a copy sheet by the transfer unit 105.

Following the transfer of the images, the copy sheet is subsequently advanced to the fixing unit 110, the toner images are permanently fixed, and then forwarded to the exterior of the copying apparatus.

Figure 11:
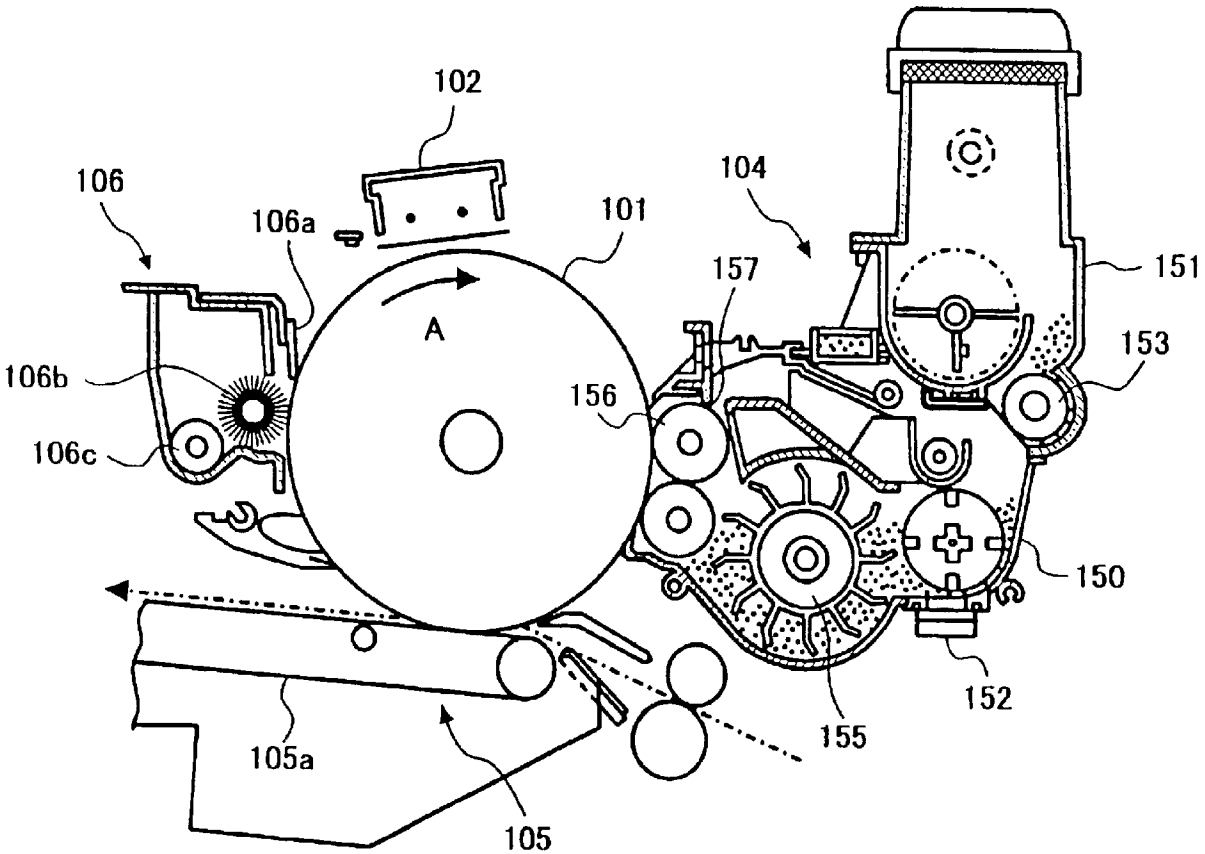
FIG. 11 is a schematic diagram illustrating major parts of the image forming apparatus of FIG. 10.

FIG. 11 is a schematic diagram illustrating process steps for supplying toner according to one embodiment disclosed herein. Referring to FIG. 11 together with FIG. 10, process steps for supplying toner will be detailed herein below.

The developing unit 104 is configured to be operative as a two-component developing system, which contains toner and carrier components as the developer in a developer tank 150. As the developing steps of toner images proceeds with repetition with the toner supplied to the photoreceptor 101, the toner is consumed to thereby result in the decrease in the amount thereof.

In order to compensate for the toner decrease and to maintain the proper toner content, the toner is replenished from a toner hopper 151, when the toner content Vt in the developer becomes lower than a predetermined value with the reference content Vref. The toner content Vt in the developer is obtained by a photo-sensor unit 152, located in the bottom portion of the developer casing, through the measurement of light transmissivity.

In addition, the reference content Vref of the toner is determined based on the values Vsp obtained with a photo-sensor from the measurements of toner images formed on the photoreceptor specifically formed for the measurement (i.e., P pattern).

Being supplied from a toner hopper 151 by way of a supplying roll 153, the toner is admixed with carrier and then stirred to be charged by friction (or triboelectrified). Subsequently, the thus prepared developer consisting of toner and carrier is sent to a developing roll 156 by a paddle-wheel 155, and adhered to the developing roll 156 by a magnet housed therein.

The developer is then carried by a sleeve provided in the outer periphery of the developing roll 156, while the remainder of the developer is scraped off by a developing doctor blade 157. The developer transferred as above toward the photoreceptor is subsequently adhered in a manner corresponding to the latent image previously formed.

The toner image on the surface of the photoreceptor drum 101 is brought in contact with the copy sheet and then electrostatically transferred by the transfer means 105 to the contacting side of the copy sheet, while some portion of the developer amounting to approximately 10% is left as non-transferred on the photoreceptor 101.

This residual portion of the developer is then removed from the photoreceptor 101 by scraping off with a cleaning blade 106*a* or brush roll 106*b*, which is housed in the cleaning unit 106 and suitably adapted to remove the residual toner.

The thus removed portion, or recovered toner, subsequently falls under gravity through an exhaust port 106*c* to be forwarded by a toner guide member 116 (FIG. 12A) to a pneumatic conveyor means for later use as recycled toner. The toner guide member 116, therefore, serves also as a means for conveying the recycled toner from the cleaning unit 106 to the pneumatic conveyor means.

In addition, since some portion of the toner adheres to a certain extent onto the transfer belt 105*a* as well, which is caused by contacting either to non-transferred or non-image portion during the transfer, another cleaning means 111 (FIG. 10) is provided to remove such toner portion. This portion on the transfer belt 105*a* can be removed by a cleaning blade (not shown) which is provided in scraping contact with the outer periphery of the transfer belt 105*a*.

The thus scraped and recovered toner portion is more likely to include foreign substances such as paper dusts, for example. In the present embodiment, therefore, the recovered toner portion is not utilized as the recycled toner, but rendered to fall under gravity through another exhaust port 105*b* (FIG. 12B) and to be sent to a toner waste tank 114.

Figure 12A:
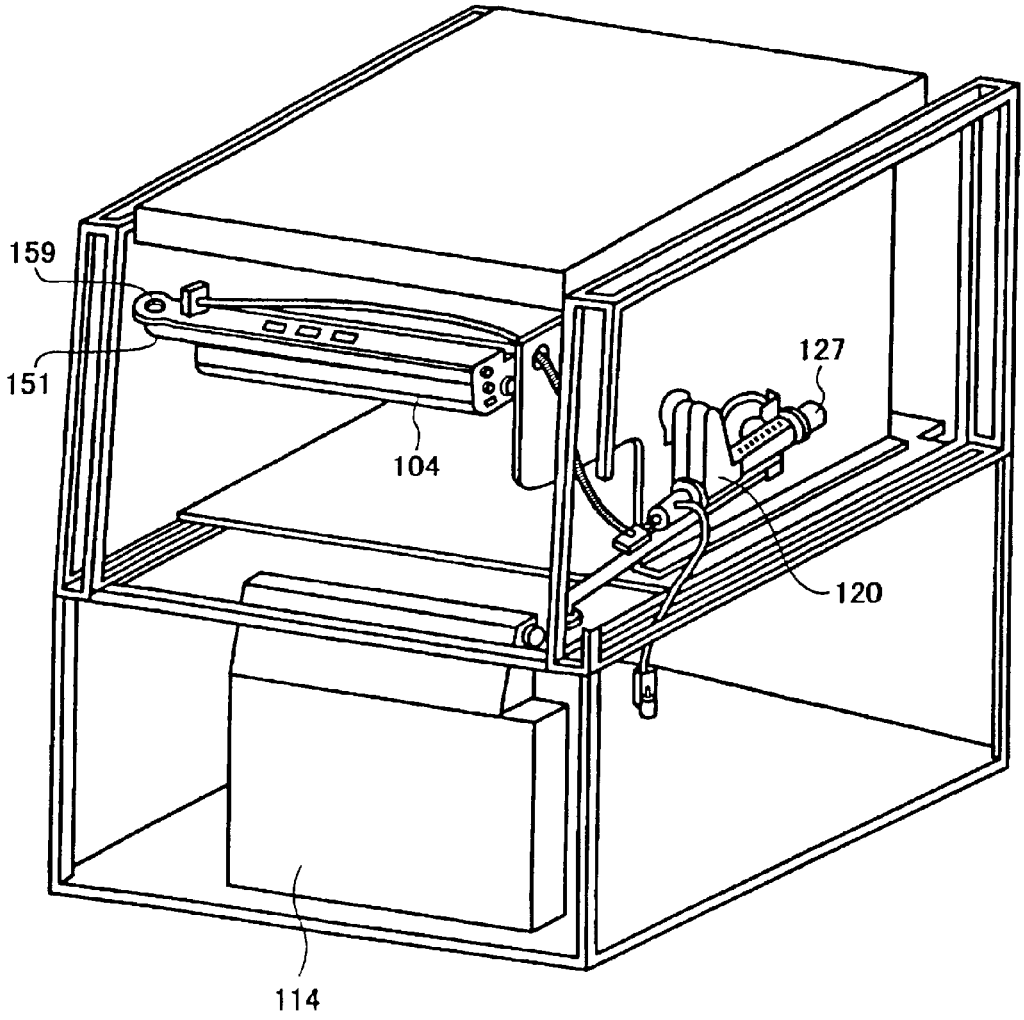
FIG. 12A is a view illustrating the toner supplying unit incorporated into the copying apparatus disclosed herein.
Figure 12B:
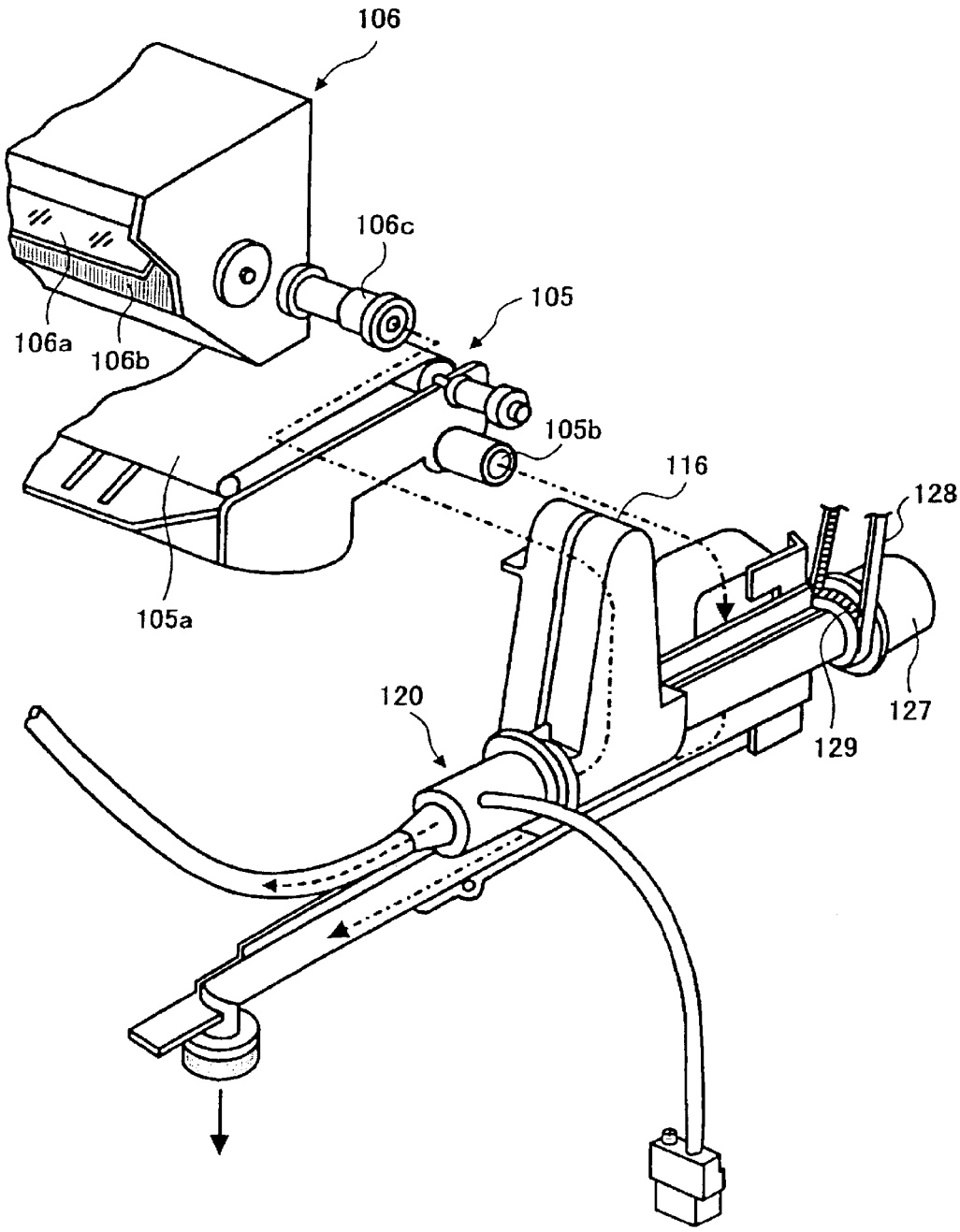
FIG. 12B is a detailed view of the major elements of the toner supplying unit of FIG. 12A.

FIG. 12A is a view illustrating the toner supplying unit incorporated into the copying apparatus disclosed herein and FIG. 12B is a detailed view of the major elements of the toner supplying unit.

Figure 13:
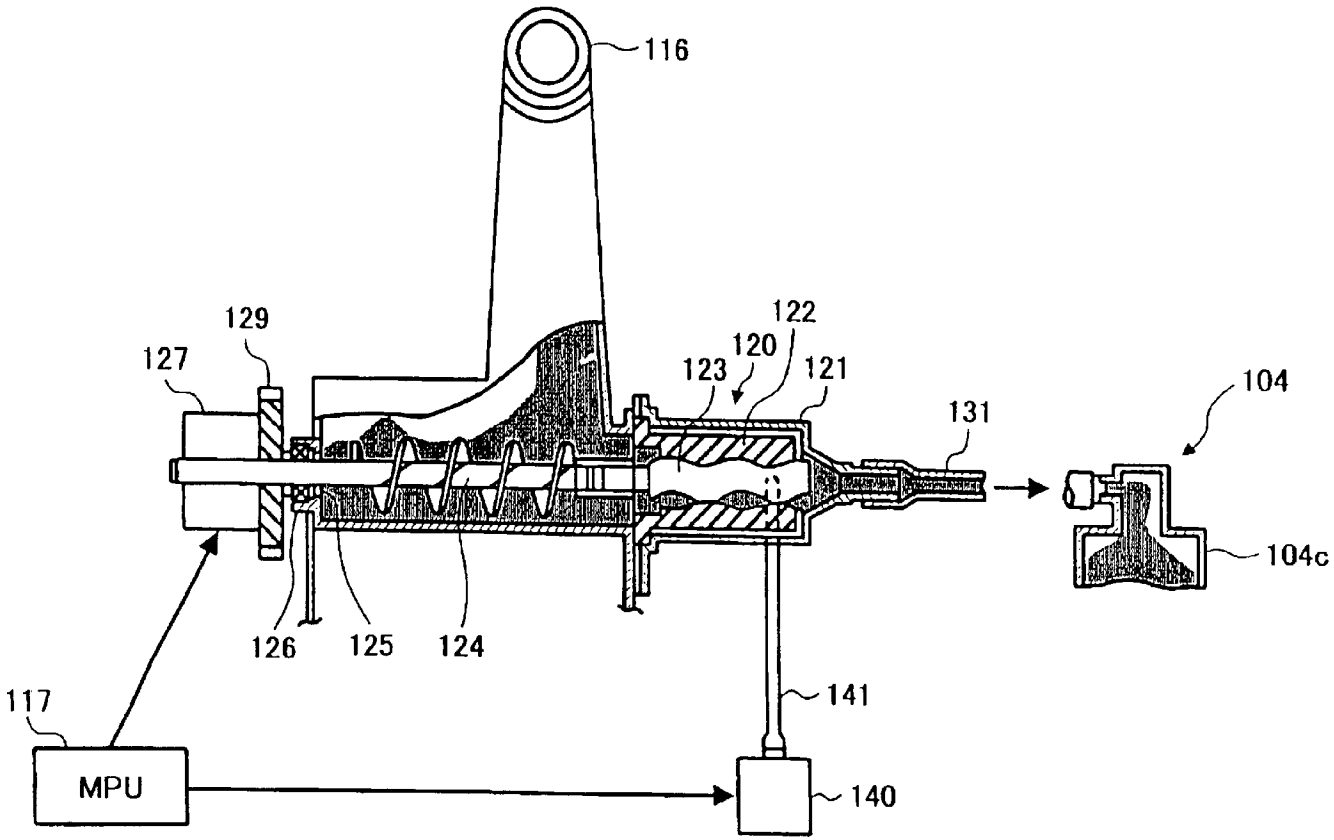
FIG. 13 is a detailed section view of the powder pump of FIG. 12B.

FIG. 13 is a cross section of a powder pump portion included in the toner supplying unit, in which the powder pump 120 is provided in combination with the toner guide member 116 as a pneumatic transport means for transporting the toner portion recovered by the cleaning unit 106 to the developing means 104.

The powder pump 120 (or transporting means for recovered toner) is configured to render the recovered toner as a gaseous mixture and then convey to the developing means 104 by means of the pneumatic conveyor means which will be detailed later on.

The powder pump 120 consists of a stator 122 which is provided being fixed in the interior of a cylindrical holder 121, having an approximately screw-shaped hollow structure inside thereof, a rotor 123 with another approximately screw-shaped surface structure which is provided rotatory along the axis of the cylindrical holder 121 in contact with inner wall face of the stator 122.

With this structure, therefore, the rotor 123 is provided to be enshrouded by the stator 122, while retaining a passage formed along the cylindrical axis throughout rotation. In addition, at one end of the rotation axis thereof, the rotor 123 is connected to the axis of longitudinal transfer screw 124.

The other end of the longitudinal transport screw 124, in turn, is connected to a seal member 125, bearing 126, and clutch 127, and the rotor 123 and longitudinal transport screw 124 are both rotatively driven by the driving force transmitted from the main console of the copying apparatus by way of a timing belt 128, timing pulley 129, and clutch 127.

The powder pump 120 is configured to be operated by a micro processing unit (MPU) 117 as a control unit so as to initiate the pump revolution and corresponding toner transport, and subsequently to terminate the revolution and toner transfer after a certain period of time, to thereby achieve intermittent revolution of the powder pump 120 and intermittent toner transport, accordingly.

Constituting the major part of the control unit (intermittent toner transfer means), the micro processing unit (MPU) 117 consists of a first signal setup means for establishing a first set of signals for starting the rotation of photoreceptor drum 101, a second signal setup means for establishing a second set of signals based on the number of pixels for image formed on the photoreceptor drum 101, and a third signal setup means for establishing a third set of signals based on the beam intensity emitted from LD (semiconductor laser diode) device housed in the exposure means 103.

The MPU 117 is configured herein to be capable of firstly computing the product of the value established by the second signal setup means (second setup signal value) and the value established by the third signal setup means (third setup signal value), and secondly, on determining for the product to reach a predetermined value, initiating the rotation of the toner recovery transfer system.

In addition, the MPU 117 is also capable of initiating rotation of the toner recovery transport system, and then terminating the rotation after a predetermined period of time.

Figure 14:
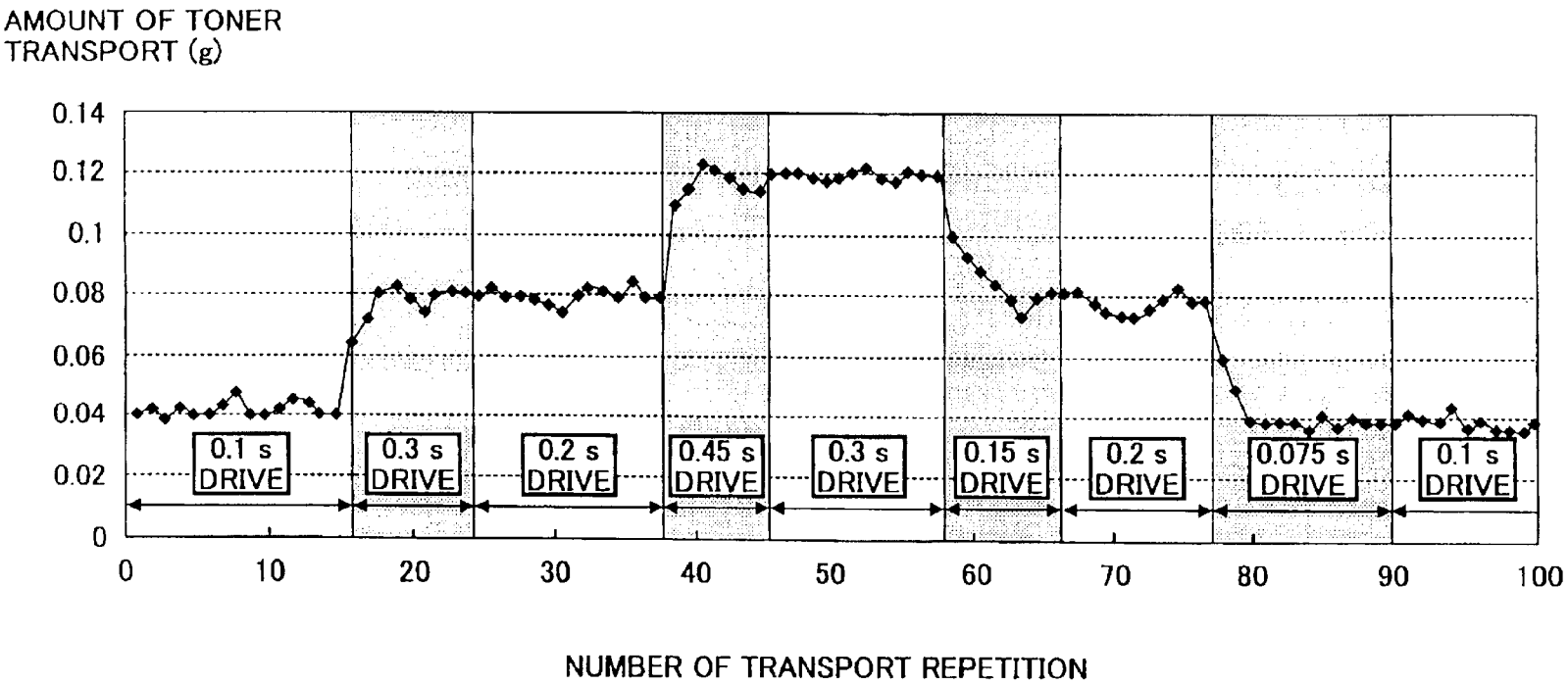
FIG. 14 contains a graph illustrating experimental results on the change of the toner amount during various driving mode of the powder pump including transient drives.

During the aforementioned intermittent driving of the powder pump 120 with the MPU 117, the amount of toner transported or supplied (g) can suitably be adjusted by switching the unit driving time to 0.1 sec, 0.2 sec, 0.3 sec and so on, while retaining the number of revolutions (rpm) of the rotor 123 to remain constant as shown in FIG. 14.

In the present example, following 15 times of repeated intermittent drives with the unit driving time of 0.1 sec, transient drives are carried out for a predetermined number of times with 0.3 sec unit driving time (i.e., transient unit driving time), which is followed by additional drives with 0.2 sec unit driving time. As a result, as shown in FIG. 14, the period of time required for achieving the target amount of toner transfer with 0.2 sec unit driving time can be reduced considerably.

That is, when the intermittent driving mode is intended to switch from a first unit driving time (for example, 0.1 sec) to a second unit driving time longer than the first (for example, 0.2 sec) to thereby result in an increase in the toner amount to be transported (for example, 0.08 g), the time required for achieving this increase can be reduced by carrying out transient drives with transient unit driving time (i.e., 0.3 sec) which is defined as the above noted intended unit driving time (i.e., 0.2 sec) multiplied by a prescribed number (i.e., 1.5), as evidenced by the above example.

The present method for adjusting the unit driving time is not limited to the specific example mentioned just above, but may also be applied to other cases such as, for example, switching from the first 0.2 sec unit driving time to the second 0.3 sec unit driving time, as well. Since the prescribed number (i.e., 1.5) times intended unit driving time (i.e., 0.3 sec) is 0.45 sec in this case, the intermittent driving is carried out by first implementing transient drives with 0.45 sec transient unit driving time for a predetermined number of times, and then switching to the second intermittent driving mode with 0.3 sec unit driving time, to thereby be able to achieve quickly the intended transported toner amount of 0.12 g.

Although the prescribed number in the above examples was stated to be 1.5 as the multiplication factor for obtaining transient unit driving time from the second unit driving time, it is noted herein that this value may be different depending on the characteristics of the powder pump utilized.

In contrast, when the intermittent driving mode is intended to switch from a first unit driving time (for example, 0.3 sec) to a second unit driving time shorter than the first (for example, 0.2 sec) in order to decrease the toner amount to be transported, the time required for achieving this decrease can be reduced by carrying out transient drives with transient unit driving time (i.e., 0.15 sec) which is another prescribed number (i.e., 0.75) times intended unit driving time (i.e., 0.2 sec), to thereby be able to decrease the amount of toner transport to be 0.08 g.

Although the prescribed number was taken to be 0.75 as the multiplication factor in the above example, it is noted herein again that this value may be different depending on the characteristics of the powder pump utilized.

It is shown in the above examples, by adopting the method disclosed herein for controlling intermittent drives of the powder pump 120, the speedy control of the appropriate amount of transferred toner and the concomitant adjustment responsive to the change of operating parameters become feasible. As a result, the amount of the toner supplied into the copying apparatus is appropriately controlled always in a timely manner throughout the copying steps, thereby facilitating to maintain satisfactory qualities of resultant copy images.

In another aspect of the present disclosure, the aftereffects of the number of transient drives can be calculated as follows.

The transient drives, which are carried out following the first unit time drives, may affect the result of intended second unit time drives after the aforementioned switching. Therefore, it is desirable to alleviate such aftereffects, and to find the number of transient drives suitable for alleviating such effects. Such a number is obtained by relation $$X>60P/nT \quad (1),$$

where p is the number of rotor pitch, n the number of rotor revolution (rpm), and T the unit driving time in the previous driving mode.

That is, the above defined number of transient drives, X, represents the threshold suitable for alleviating the undue aftereffects such as, for example, slower or delayed response for toner amount adjustment.

Therefore, when the relation (1) is fulfilled, or the number of transient drives is below the threshold X value, since the level of toner amount fluctuation in the powder pump is small enough to not cause appreciable aftereffects, the driving mode may be appropriately switched to the second mode, as shown in FIG. 14.

Figure 15:
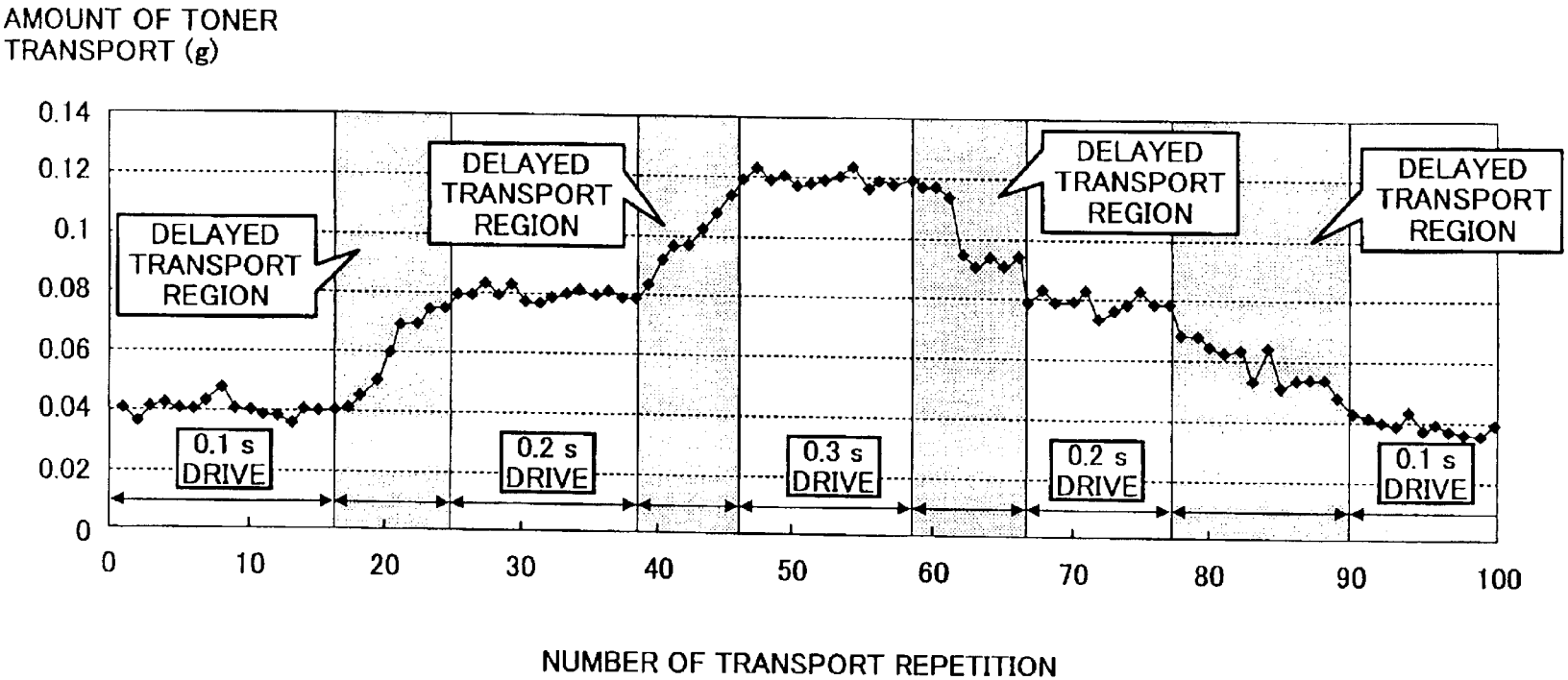
FIG. 15 contains a graph illustrating prior results on the change of the toner amount during various driving mode of the powder pump, in which several delays in toner supply are caused.

In previous method of driving as exemplified in FIG. 15, in contrast, the intermittent driving is switched directly from a first unit driving time to a second unit driving time. As a result, speedy response to the toner amount change has not properly been achieved.

In other words, the toner supply amount can not follow quickly the change of driving mode immediately after the switching. As a result, the toner amount can not reach the amount specified by a second unit driving time, but a delay in time arises before reaching the desirable amount of toner supply.

This is considered due to the fact that the effect of a first (or previous) mode drives on a second mode drives persists until the entire toner related to the first mode drives is completely disposed from the interior of the stator (the number of drives in the relation (1) to satisfy this disposition is herein designated as 'Y'), and that a stable amount of toner supply is achieved after the disposition.

In the method disclosed herein, in contrast to the method previously employed, when aftereffects (which may be either undue increase or decrease depending on the specific case) are anticipated after intermittent drives with a certain unit driving time repeated X times, speedy response and concomitant achievement of the desired toner amount become feasible by temporally carrying out transient drives repeated Y times with unit driving time decreased (alternatively increased depending the specific case) by a prescribed factor. In such a case, the largest number of transient drives to be carried out with the decreased (or increased) unit driving time can be obtained from the relation $$Y \geqq 60P/nT \quad (2),$$

where p is the number of rotor pitch, n the number of rotor revolution (rpm), and T the unit driving time after switching the driving mode.

When the number of transient drives is not controlled by the above specified value by the relation (2), however, the toner amount continues to increase (or decrease) to thereby exceed the desired amount. Therefore, before the point of time at which the number of transient drives is exceeded, the revolution is preferably switched to those having a succeeding unit driving time, as shown in the shaded portions in FIG. 15.

Accordingly, in the case of switching of transient drives from 0.1 sec mode to 0.2 sec mode, as shown again in FIG. 14, for example, since the desired toner amount of 0.08 g is already achieved after the third drive (or 18th drives from the beginning) of the transient drive with the 0.3 sec unit driving time, the desired drives with 0.2 sec unit driving time may be carried out starting from the fourth drive.

If the transient drives with the 0.3 sec mode continue beyond the ninth drive (24th from the beginning), however, the toner amount well exceeds the desired level of 0.08 g. Therefore, this indicates that the 0.3 sec mode of the transient drives preferably be terminated at least at ninth drive and then switched to the second intermittent drives with the 0.2 sec mode.

Although the present disclosure has been described hereinabove on the powder pump incorporated into the toner recycling system, the control methods disclosed herein may also be adoptable to a powder pump for use in supplying the toner from a toner tank or container to a copying apparatus separately located, in similar manner described earlier on the toner supply system including a plurality of stations.

The apparatuses and process steps set forth in the present description may therefore be implemented using suitable host computers and terminals incorporating appropriate processors programmed according to the teachings disclosed herein, as will be appreciated to those skilled in the relevant arts.

Therefore, the present disclosure also includes a computer-based product which may be hosted on a storage medium and include instructions which can be used to program a processor to perform a process in accordance with the present disclosure. The storage medium can include, but is not limited to, any type of disk including floppy disks, optical disks, CD-ROMS, magneto-optical disks, ROMs, RAMs, EPROMs, EEPROMS, flash memory, magnetic or optical cards, or any type of media suitable for storing electronic instructions.

It is apparent from the above description including the examples, the methods and systems disclosed herein for transferring the toner have several advantages over similar methods previously known.

Since the powder pump in the image forming apparatus is driven by its exclusive motor independently of a main motor provided for driving major parts of the image forming apparatus, the toner supply unit is capable of implementing responsive supply of the toner unaffected by the operation mode change of the image forming apparatus with a simpler construction of the supply unit.

In addition, by adjusting the number of revolutions of the powder pump to be equal to, or greater than, 250 rpm, a desirable amount of toner transport can practically be achieved in a relatively short time.

The toner supply system can also be provided in a similar manner using plural powder pumps for an image forming apparatus provided with a plurality of color developing stations. By additionally considering the distance and elevation of transfer tubes connected to the respective stations, the appropriate number of pump revolutions can be found for respective stations. As a result, desirable amounts of toner transport to respective stations can suitably be achieved in a relatively short time with a simpler construction of the supply unit.

In another aspect, by adopting the method disclosed herein for controlling intermittent drives of the powder pump incorporated into the image forming apparatus, the speedy control of the appropriate amount of toner transfer and the concomitant adjustment responsive to the change of operating parameters become feasible. As a result, the amount of the toner supplied into the image forming apparatus is appropriately controlled always in a timely manner throughout the image forming steps, thereby facilitating to maintain satisfactory qualities of resultant images.

The present method is further characterized by switching intermittent driving mode from one unit driving time to another to thereby result in an appropriate adjustment of the toner amount to be transferred, in which the time required for achieving this adjustment can be reduced by carrying out transient drives with transient unit driving time which is a prescribed number times intended unit driving time.

In addition, the relation is obtained in the present disclosure, in that the level of toner amount fluctuation in the powder pump can be made small enough not to cause undue aftereffects in the following intermittent drives, if the number of transient drives is below a certain threshold value specified by the aforementioned relation, $X \geqq 60P/nT$.

Obviously, additional modifications and variations of the present invention are possible in light of the above teachings. It is therefore to be understood that within the scope of the appended claims, the invention may be practiced otherwise than as specifically described herein.

This document claims priority and contains subject matter related to Japanese Patent Applications No. 2001-132478 and 2001-150934, filed with the Japanese Patent Office on Apr. 27, 2001 and May 28, 2001, respectively, the entire contents of which are hereby incorporated by reference.

What is claimed is:

1. A toner supply system comprising:

an image forming apparatus for supplying toner, said image forming apparatus including:

at least a plurality of developing stations, said toner being supplied to said plurality of developing stations from respective toner containers by respective powder pumps included in said toner supply system, each of said powder pumps including at least a stator provided therein with a through hole, and a rotor rotatably interfit to said through hole in said stator;

wherein each of said powder pumps is driven by an own exclusive motor independently of a main motor provided for driving major parts of said image forming apparatus, and wherein a number of revolution of each of said respective powder pumps is adjusted individually in advance.

2. A toner supply system comprising:

an image forming apparatus for supplying toner, said image forming apparatus including:

at least a plurality of developing stations, said toner being supplied to said plurality of developing stations from respective toner containers by respective powder pumps included in said toner supply system, each of said powder pumps including at least a stator provided therein with a through hole, and a rotor rotatably interfit to said through hole in said stator;

wherein each of said powder pumps is driven by an own exclusive motor independently of a main motor provided for driving major parts of said image forming apparatus, and wherein a number of revolutions of each of said respective powder pumps is adjusted corresponding to a distance and an elevation of toner transport path to each of said plurality of developing stations.

3. A method for controlling an amount of toner transported by a toner supply system incorporated into an image forming apparatus for supplying toner, said image forming apparatus including at least a plurality of developing stations, said toner being supplied to said plurality of developing stations from respective toner containers by respective powder pumps included in said toner supply system, each of said powder pumps including at least a stator provided therein with a through hole, and a rotor rotatably interfit to said through hole in said stator;

comprising:

driving each of said powder pumps by an exclusive motor independently of a main motor provided for driving major parts of said image forming apparatus, wherein a number of revolutions of each of said respective powder pumps is adjusted individually in advance.

4. The method for controlling an amount of toner transported by a toner supply system incorporated into an image forming apparatus for supplying toner, said image forming apparatus including at least a plurality of developing stations, said toner being supplied to said plurality of developing stations from respective toner containers by respective powder pumps included in said toner supply system, each of said powder pumps including at least a stator provided therein with a through hole, and a rotor rotatably interfit to said through hole in said stator;

comprising:

driving each of said powder pumps by an exclusive motor independently of a main motor provided for driving major parts of said image forming apparatus, wherein a number of revolutions of each of said respective powder pumps is adjusted corresponding to a distance and an elevation of toner transport path to each of said plurality of developing stations.

5. An image forming apparatus comprising:

at least a developing unit for forming a toner image by developing a latent image formed on an image bearing member using toner supplied to said image bearing member;

a powder pump for transporting said toner to said developing unit; and a control unit for driving said powder pump;

said powder pump including at least a stator provided therein with a through hole, a rotor rotatably interfit to said through hole in said stator, and a motor for rotating said rotor;

said powder pump being configured to transport toner by drawing from one end of said through hole, disposing through another end of said through hole, and by conveying said toner to said developing unit;

wherein said powder pump is driven intermittently with an arbitrary unit driving time, and, when said arbitrary unit driving time is changed to another unit driving time, to be driven transiently with still another unit driving time different from any one of said arbitrary unit driving time and said another unit driving time.

6. The image forming apparatus according to claim 5, wherein, when said arbitrary unit driving time is changed to another unit driving time, a least number, X, of driving said powder pump with said arbitrary unit driving time for causing undue delay of toner transport, is determined by a relation $$X \geqq 60P/nT,$$

where p is a number of rotor pitch, n is a number of rotor revolution (rpm), and T is said arbitrary unit driving time.

7. The image forming apparatus according to claim 5, wherein a largest number, Y, for limiting said transient driving of said powder pump with still another unit driving time, which is carried out following said intermittent driving of said powder pump performed for X times with said arbitrary unit driving time, is determined by a relation $$X \geqq 60P/nT,$$

where p is a number of rotor pitch, n is a number of rotor revolution (rpm), and T is said still another unit driving time.

8. A method for controlling an amount of toner transported by a powder pump for an image forming apparatus, said image forming apparatus including at least a developing unit for forming a toner image by developing a latent image formed on an image bearing member using toner supplied on said image bearing member, a powder pump for transporting said toner to said developing unit, and a control unit for driving said powder pump; said powder pump including at least a stator provided therein with a through hole, a rotor rotatably interfit to said through hole in said stator, and a motor for rotating said rotor, said powder pump being configured to transport toner by drawing said toner from one end of said through hole, disposing said toner through another end of said through hole, and by conveying said toner to said developing unit;

comprising:

controlling said powder pump to be driven intermittently with an arbitrary unit driving time, and, when said arbitrary unit driving time is changed to another unit driving time, controlling said powder pump to be driven transiently with still another unit driving time different from any one of said arbitrary unit driving time and said another unit driving time.

9. The method according to claim 8, wherein, when said arbitrary unit driving time is changed to another unit driving time, a least number, X, of driving said powder pump with said arbitrary unit driving time for causing undue delay of toner transport is determined by a relation $$X \geqq 60P/nT,$$

where p is a number of rotor pitch, n is a number of rotor revolution (rpm), and T is said arbitrary unit driving time.

10. The method according to claim 8, wherein a largest number, Y, for limiting said transient driving of said powder pump with still another unit driving time, which is carried out following said intermittent driving of said powder pump performed for X times with said arbitrary unit driving time, is determined by a relation $$X \geqq 60P/nT,$$

where p is a number of rotor pitch, n is a number of rotor revolution (rpm), and T is said still another unit driving time.

11. A toner supply means incorporated into an image forming means for supplying toner, said image forming means including at least a plurality of developing station means, said toner being supplied to said plurality of developing station means from respective toner container means by respective powder pump means included in said toner supply means, each of said powder pump means including at least a stator means provided therein with a through hole means, and a rotor means rotatably interfit to said through hole means in said stator means;

wherein each of said powder pump means is driven by an exclusive motor means independently of a main motor means provided for driving major parts of said image forming means, wherein a number of revolutions of each of said respective powder pump means is adjusted individually in advance.

12. A toner supply means incorporated into an image forming means for supplying toner, said image forming means including at least a plurality of developing station means, said toner being supplied to said plurality of developing station means from respective toner container means by respective powder pump means included in said toner supply means, each of said powder pump means including at least a stator means provided therein with a through hole means, and a rotor means rotatably interfit to said through hole means in said stator means;

wherein each of said powder pump means is driven by an exclusive motor means independently of a main motor means provided for driving major parts of said image forming means, wherein a number of revolutions of each of said respective powder pump means is adjusted corresponding to a distance and an elevation of toner transport path means to each of said plurality of developing station means.

13. An image forming means comprising:

at least a developing means for forming a toner image by developing a latent image formed on an image bearing means using toner supplied to said image bearing means;

a powder pump means for transporting said toner to said developing means; and a control means for driving said powder pump means;

said powder pump means including at least a stator means provided therein with a through hole means, a rotor means rotatably interfit to said through hole means in said stator means and a motor means for rotating said rotor means;

said powder pump means being configured to transport toner by drawing from one end of said through hole means, disposing through another end of said through hole means, and by conveying said toner to said developing means;

wherein said powder pump means is driven intermittently with an arbitrary unit driving time, and, when said arbitrary unit driving time is changed to another unit driving time, to be driven transiently with still another unit driving time different from any one of said arbitrary unit driving time and said another unit driving time.

14. The image forming means according to claim 13, wherein, when said arbitrary unit driving time is changed to another unit driving time, a least number, X, of driving said powder pump means with said arbitrary unit driving time for causing undue delay of toner transport, is determined by a relation $$X \geqq 60P/nT,$$

where p is a number of rotor pitch, n is a number of rotor means revolution (rpm), and T is said arbitrary unit driving time.

15. The image forming means according to claim 13, wherein a largest number, Y, for limiting said transient driving of said powder pump means with still another unit driving time, which is carried out following said intermittent driving of said powder pump means performed for X times with said arbitrary unit driving time, is determined by a relation $$X \geqq 60P/nT,$$

where p is a number of rotor pitch, n is a number of rotor means revolution (rpm), and T is said still another unit driving time.

* * * * *